US006249278B1

(12) United States Patent
Segan et al.

(10) Patent No.: US 6,249,278 B1
(45) Date of Patent: Jun. 19, 2001

(54) MODULAR DYNAMIC DIALOGUE ANIMATED DISPLAY DEVICE

(75) Inventors: Marc H. Segan, New York; Steven Parker, Tuxedo Park; Gary Strauss, Mamaroneck, all of NY (US); Jerry Cummings, Marlton, NJ (US)

(73) Assignee: The Animated Animations Company LLC., New York, NY (US)

( * ) Notice: Subject to any disclaimer, the term of this patent is extended or adjusted under 35 U.S.C. 154(b) by 0 days.

(21) Appl. No.: 09/004,012

(22) Filed: Jan. 7, 1998

Related U.S. Application Data

(63) Continuation-in-part of application No. 08/779,385, filed on Jan. 7, 1997, now abandoned.

(51) Int. Cl.[7] ..... G09S 5/00
(52) U.S. Cl. ..... 345/204; 40/415; 40/455
(58) Field of Search ..... 345/204, 108, 345/110, 473, 474; 446/82, 83; 40/423, 429, 436, 446, 584, 411, 415, 455, 414

(56) References Cited

U.S. PATENT DOCUMENTS

| | | | | |
|---|---|---|---|---|
| 3,063,338 | | 11/1962 | Bregman . | |
| 3,857,191 | | 12/1974 | Sadorus . | |
| 3,928,928 | | 12/1975 | Kalust . | |
| 4,299,041 | | 11/1981 | Wilson . | |
| 4,305,131 | * | 12/1981 | Best | 364/521 |
| 4,541,188 | | 9/1985 | Sadorus . | |
| 4,934,079 | | 6/1990 | Hoshi . | |
| 5,493,185 | * | 2/1996 | Mohr et al. | 318/3 |
| 5,915,853 | * | 6/1999 | Guilin | 40/414 |

OTHER PUBLICATIONS

"Automata & Mechanical Toys", Mary Hillier, *Bloomsbury Books London,* 1988, pp. 48, 50, 94, 96 and 97.

"Bagatelle", Trianon & Terrasse, Apr. 7 to Jul. 30, 1993, pp. 11, 28, 29, 130–139.

* cited by examiner

*Primary Examiner*—Richard Hjerpe
*Assistant Examiner*—Ronald Laneau
(74) *Attorney, Agent, or Firm*—Cohen, Pontani, Lieberman & Pavane

(57) ABSTRACT

A modular dynamic dialogue animated display device for recreating a story that is divided into a stored sequence of storyline events which are sequentially retrieved by a processor. Each storyline event comprises at least one of playing a selected audio block or movement of a moveable display element. The processor generates sequential control signals which initiate performance of corresponding storyline events such that precise synchronization between audio and movement is provided. The display includes a universal main assembly which may be manufactured in a single tooling for use with different storylines, and subassemblies are mounted to the main assembly in accordance with the particular storyline being depicted. Alternatively, a plurality of individual display devices may be arranged one after another whereby a previous display device actuates performance in a next display device in order to depict different scenes from a single storyline.

47 Claims, 28 Drawing Sheets

765
LAMP AND BATTERY OK ?
N
Y
770
PLAY REQUEST FOR REPLACEMENT
775
SLEEP DISABLE AND TURN POWER OFF
780
IS 12 IN POSITION B ?
N
Y
785
MOVE 12 TO POSITION A AND THEN TO POSITION B
790
HAS THE TIMEOUT PROCESSING PERIOD ELAPSED ?
N
Y
795
IS 14 IN POSITION B ?
N
Y
800
MOVE 14 TO POSITION A AND THEN TO POSITION B
805
HAS THE TIMEOUT PROCESSING PERIOD ELAPSED ?
N
Y
POWER DOWN & AWAIT START
810

PRESS 24 FOR START
815
820
ARE 12 AND 14 IN POSITION B ?
N
Y
825
MOVE 12 AND 14 TO POSITION B
830
HAS THE TIMEOUT PROCESSING PERIOD ELAPSED ?
N
Y
835
SLEEP DISABLE AND TURN POWER OFF
840
AUDIO UNIT 28 READY ?
N
Y
845
PLAY INTO MUSIC
850
MOTOR 51 MOVES 14 TO POSITION A
855
IS 14 IN POSITION A ?
N
Y
860
HAS THE TIMEOUT PROCESSING PERIOD ELAPSED ?
N
Y
865
SLEEP DISABLE AND TURN OFF POWER
870
IS AUDIO UNIT 28 READY ?
N
Y

FIG. 8a
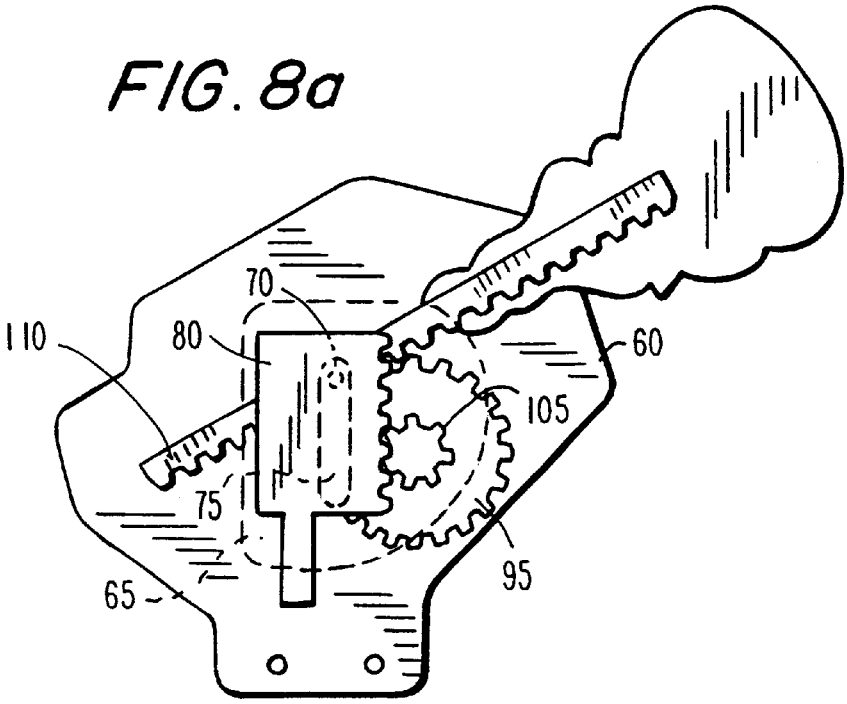
FIG. 8b
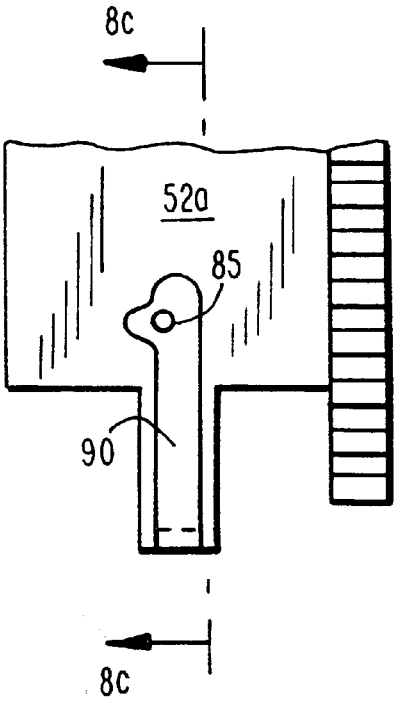
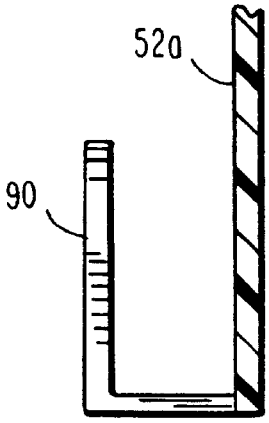
FIG. 8c

S6
205
185
195
B
A
150u
190
255b2
255b3
125b
255h2
255h3
125h
260h
R5
R4
R3
S8
S11
S10
R2
265b
R1
S9
260b
245h
240h
240b
245b
262
250h
250b
255h1
150c
23
19
20
S7
235
225
220
215
150b
26
27
28
21
10

1445
GEARBOX 150b MOVES 135; GEARBOX 150c MOVES 125h TO POSITION C; PLAY "HELP" BIRD SCRIPT
1450
IS 125h IN POSITION C ?
N
1455
HAS THE TIMEOUT PROCESSING PERIOD ELAPSED ?
Y
1460
SLEEP DISABLE AND TURN OFF POWER
Y
1465
PLAY CAT SPEECH
1470
IS AUDIO UNIT 28 READY ?
N
Y
1475
GAER BOX 150u MOVES 140 TO POSITION A
1480
IS 140 IN POSITION A ?
N
1485
HAS THE TIMEOUT PROCESSING PERIOD ELAPSED ?
Y
1490
SLEEP DISABLE AND TURN OFF POWER
Y

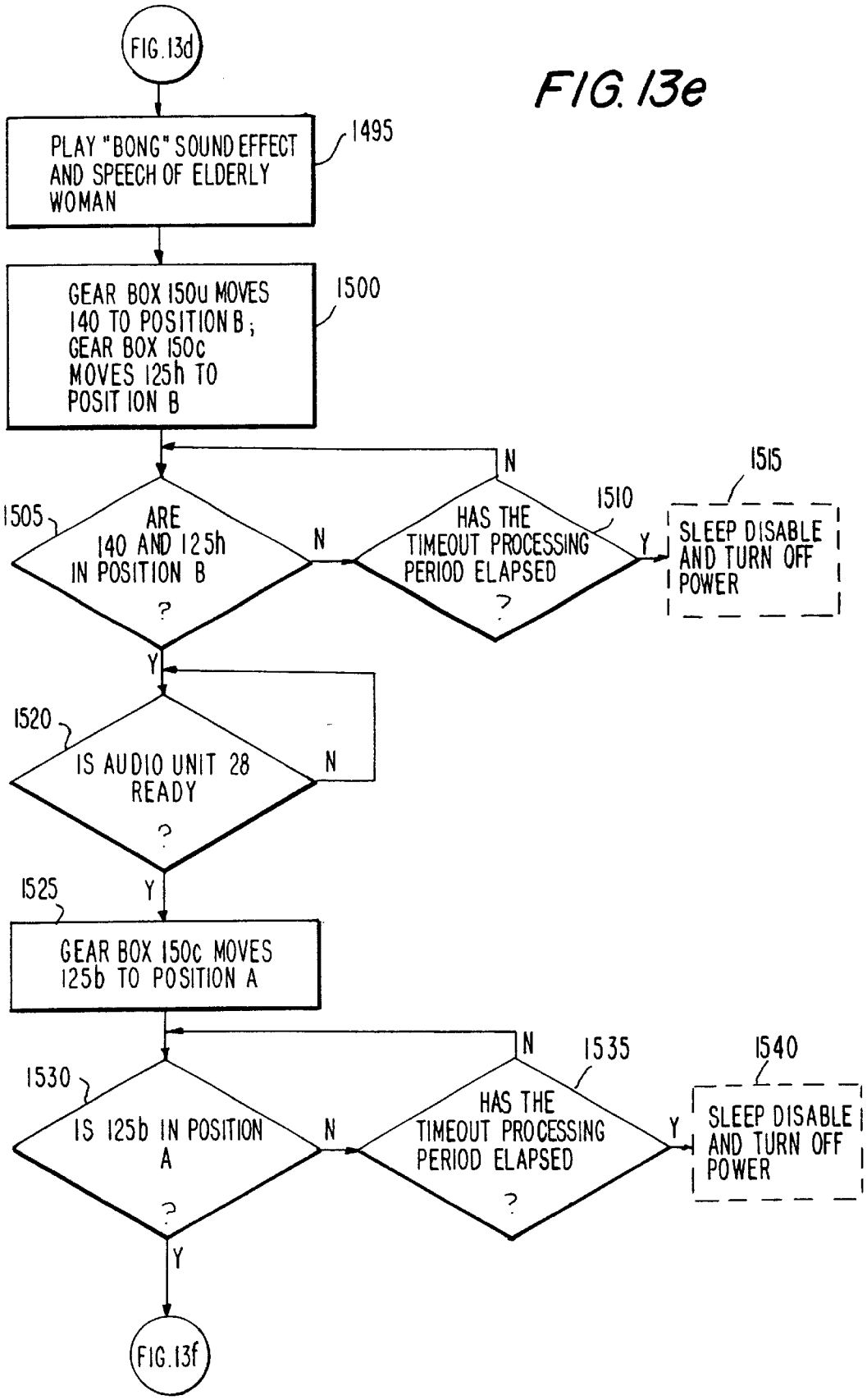
FIG. 13d
FIG. 13e
PLAY "BONG" SOUND EFFECT AND SPEECH OF ELDERLY WOMAN
1495
GEAR BOX 150u MOVES 140 TO POSITION B; GEAR BOX 150c MOVES 125h TO POSITION B
1500
ARE 140 AND 125h IN POSITION B ?
1505
N
HAS THE TIMEOUT PROCESSING PERIOD ELAPSED ?
1510
N
Y
SLEEP DISABLE AND TURN OFF POWER
1515
Y
IS AUDIO UNIT 28 READY ?
1520
N
Y
GEAR BOX 150c MOVES 125b TO POSITION A
1525
IS 125b IN POSITION A ?
1530
N
HAS THE TIMEOUT PROCESSING PERIOD ELAPSED ?
1535
N
Y
SLEEP DISABLE AND TURN OFF POWER
1540
Y
FIG. 13f

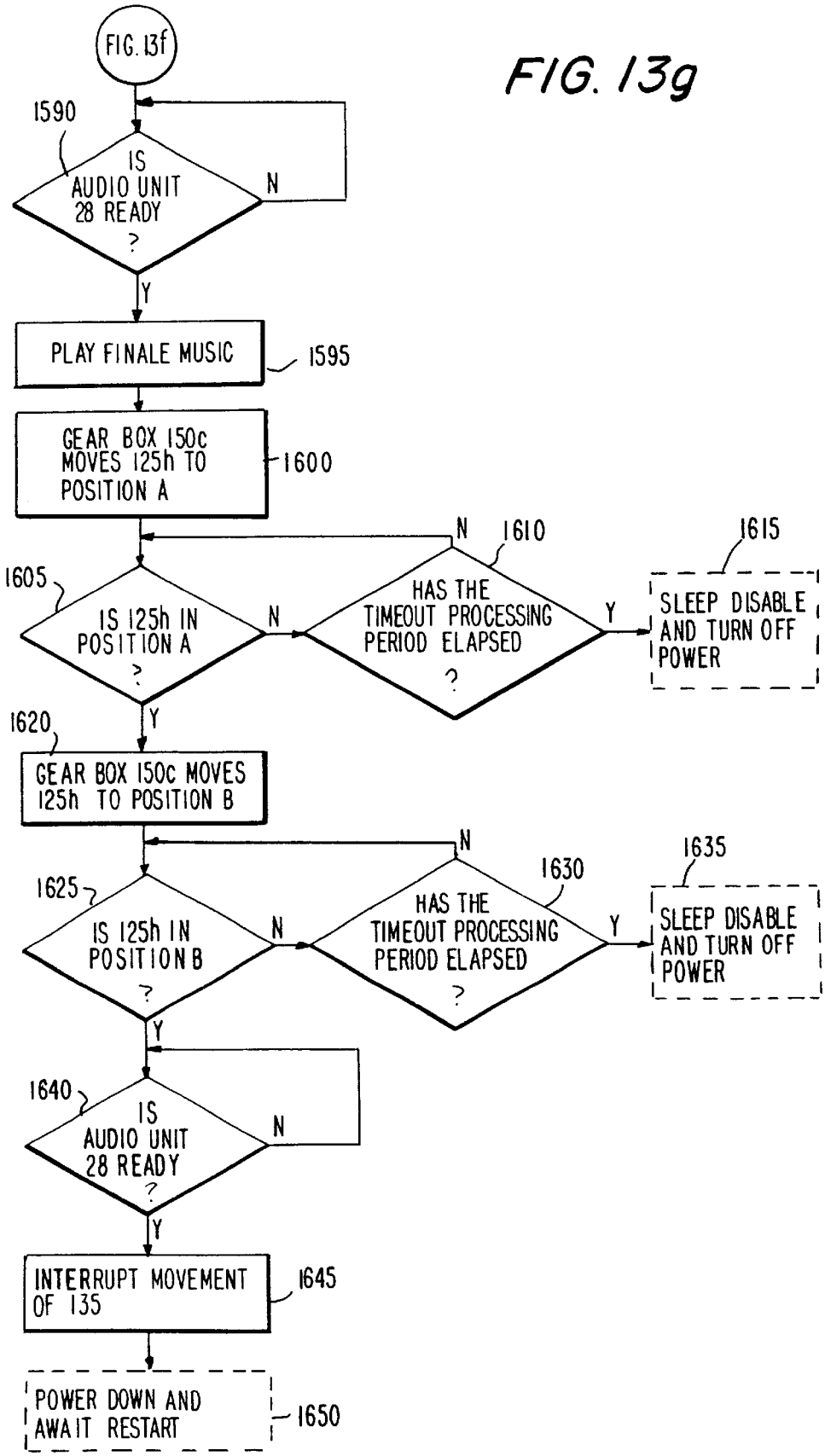
FIG. 13f
FIG. 13g
1590
IS AUDIO UNIT 28 READY ?
N
Y
PLAY FINALE MUSIC
1595
GEAR BOX 150c MOVES 125h TO POSITION A
1600
N
1610
1615
1605
IS 125h IN POSITION A ?
N
HAS THE TIMEOUT PROCESSING PERIOD ELAPSED ?
Y
SLEEP DISABLE AND TURN OFF POWER
Y
1620
GEAR BOX 150c MOVES 125h TO POSITION B
N
1630
1635
1625
IS 125h IN POSITION B ?
N
HAS THE TIMEOUT PROCESSING PERIOD ELAPSED ?
Y
SLEEP DISABLE AND TURN OFF POWER
Y
1640
IS AUDIO UNIT 28 READY ?
N
Y
INTERRUPT MOVEMENT OF 135
1645
POWER DOWN AND AWAIT RESTART
1650

FIG. 14a
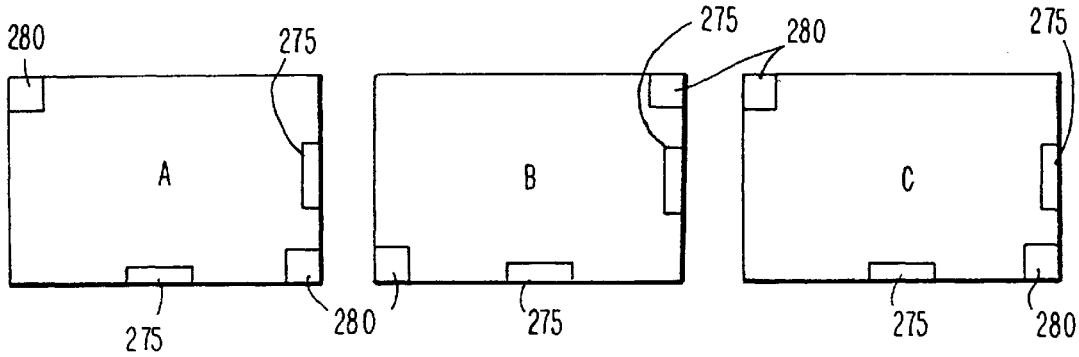
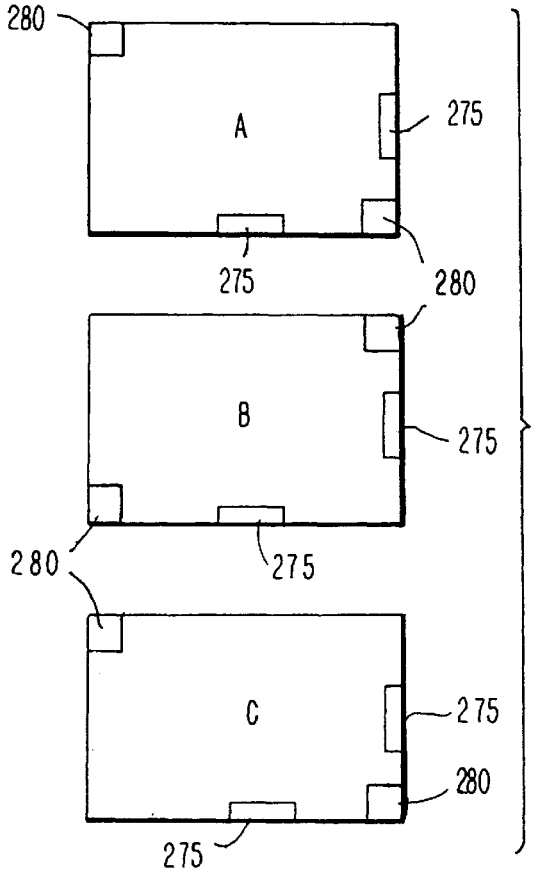
FIG. 14b

MODULAR DYNAMIC DIALOGUE ANIMATED DISPLAY DEVICE

This application is a continuation in part of Ser. No. 08/779,385, filed Jan. 7, 1997, now abandoned.

BACKGROUND OF THE INVENTION

1. Field of the Invention

The present invention is directed to an audio-visual display apparatus and, in particular to a modular dynamic dialogue animated display device for recreating an animated cartoon.

2. Description of Related Art

Mechanical-action tableau have been around for centuries. Early displays were individually handcrafted by skilled artisans and typically included three-dimensional mechanical figurines such as jousting knights or dancing bears that provided entertaining backgrounds for town hall clocks and other mechanical devices. Similar displays were also manufactured on a smaller scale for use at home in music boxes and clocks. The action imparted to the figurines was provided by mechanical gears that were wound by hand or moving sand. Often times action of the figurines was accompanied by background music provided by a pin-programmable mechanical music box.

Thereafter, electric motors replaced the mechanical elements used to drive the early tableau and phonographs and taped audio loops replaced pin-programmable music boxes as a sound source for the audio-visual displays. These devices, however, fail to provide highly synchronized action and sound and thus, like their earlier mechanical counterparts, do not produce a realistic story.

Thereafter, cartoon animation involving precisely synchronized audio-visual entertainment was developed to simulate more realistic actions and associated sounds than previous mechanical or electronic tableau. Animated cartoons are created from a sequence of individual two-dimensional still frame images called "cells". The individual frames or cells are sequentially arranged and flipped through quickly to create animated action or, alternatively, the cells can be selectively printed as individual still photos or "story boards".

It is desirable to develop a modular dynamic animated display device for realistically recreating animated stories. Such a display requires precisely synchronized distinctive voices, characteristic sound effects and dramatic actions which are essential to the overall quality and entertainment value of an animated cartoon. The type of timing and coordination required for this type of dynamic interaction of sound and movement is qualitatively, as well as quantitatively different than that provided by conventional mechanical and electrical tableau. In particular the elements must simulate varied and complex movements such as pacing and startled reactions in order to realistically recreate dramatic effects. Furthermore, it is desirable for the dynamic display device to be modular for mass-production at a relatively inexpensive cost of manufacture yet still be adaptable to depict a variety of storylines.

SUMMARY OF THE INVENTION

The present invention relates to a modular dynamic dialogue animated three-dimensional display for realistically recreating an animated cartoon. Typically, the animated cartoon is a narration of a storyline having a beginning, a development phase, a climax and a denouement that is reliably and autonomously replicated each time the display is activated. The storyline is divided into a stored sequence of storyline events comprising playing of a selected audio block, movement of a moveable display element and/or lighting a lamp element and/or timing a pause or delay element. A central processor sequences through the storyline events and initiates performance of the corresponding event. Randomly accessible blocks of stored audio data are retrieved in response to control signals generated by the central processor. The control signals produced by the central processor initiate movement of moveable display elements synchronized with the playing of the audio blocks.

In a first illustrative example movement of the display elements is restricted between electronic switches disposed along a path of travel. The second example depicts a different storyline but using a simplified construction which requires less switches and includes universal gear boxes to move the moveable display elements. This example is suitable for a storyline in which the movements are continuous and periodic. Alternatively, the construction shown in the first and second examples may be combined as desired to recreate a particular storyline. It is beneficial to increase the modularity of the display device whenever possible, as for example by using universal gear boxes or reducing the number of switches, in order to reduce the overall time and cost of manufacture of the display.

Another embodiment of the invention includes a plurality of modular dynamic dialogue animated display devices arranged one after another in sequence to recreate several different scenes of a single storyline. Each of the display devices includes some type of means for actuating the display devices in series such as by electrical wires or by wireless communication, as for example, radio or IR waves.

BRIEF DESCRIPTION OF THE DRAWINGS

In the drawings wherein like reference numerals denoted similar elements throughout the several views:

FIG. 8*a* is a detailed back view of the glove actuating mechanism in the display of FIG. 1;

FIG. 8*b* is a partial front view of the rack driving the rabbit in the display of FIG. 1;

FIG. 8*c* is a partial side view of the rack of FIG. 8*b;*

FIGS. 13*a*–13*g* are operational flowcharts of the display of FIG. 9;

FIG. 14*a* is another embodiment of the present invention including a plurality of modular dynamic dialogue display devices arranged horizontally; and FIG. 14*b* shows a vertical arrangement of modular dynamic dialogue display devices in accordance with the present invention.

DETAILED DESCRIPTION OF THE PREFERRED EMBODIMENTS

The modular dynamic dialogue animated display device in accordance with the present invention will be described for illustrative purposes only with respect to several different storylines. However, and as will be apparent as this description progresses, it is within the intended scope of the invention to modify the display to depict any desired storyline.

Figure 1:
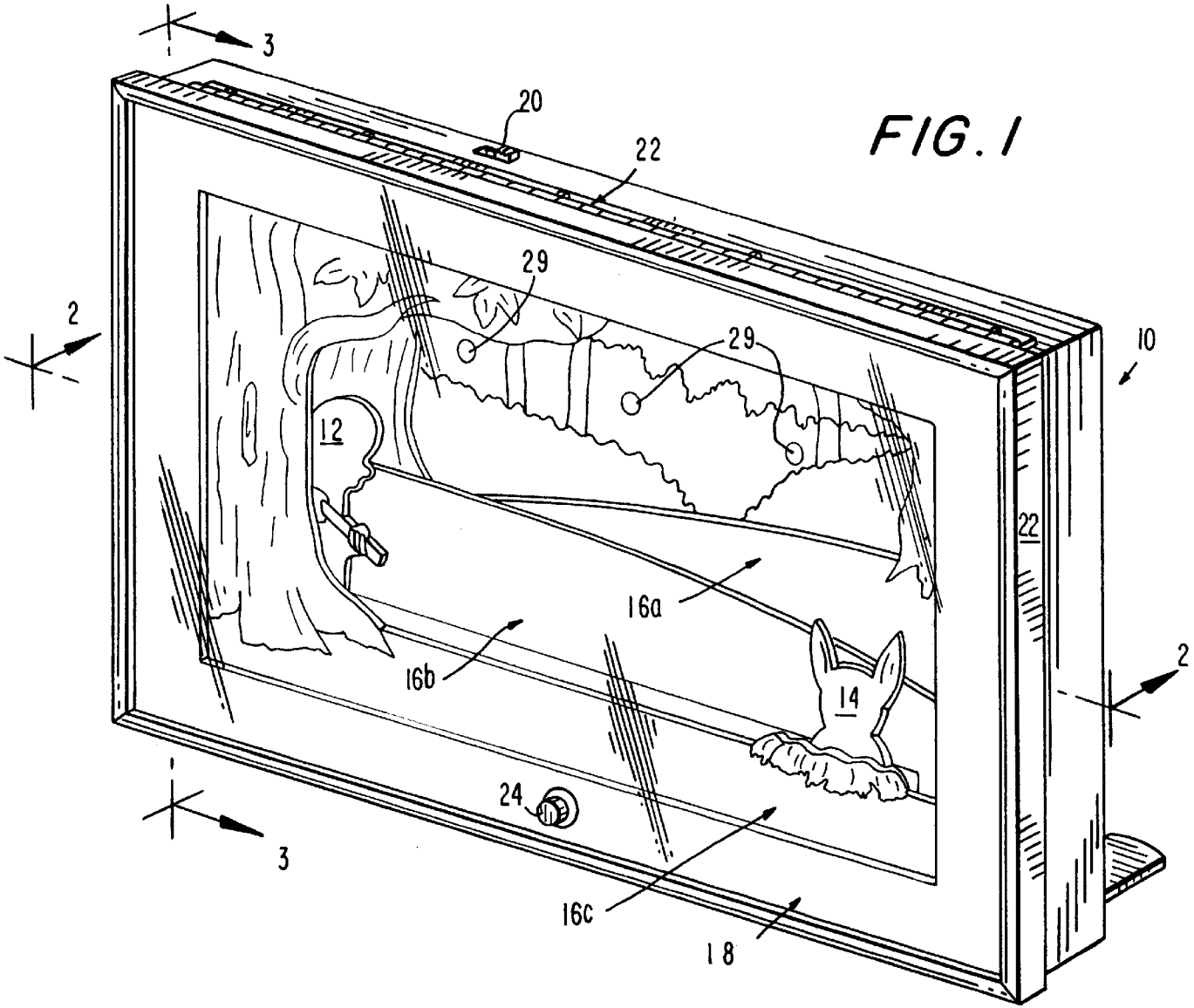
FIG. 1 is a plan view of a first example of the modular dynamic animated display according to the present invention.
Figure 2:
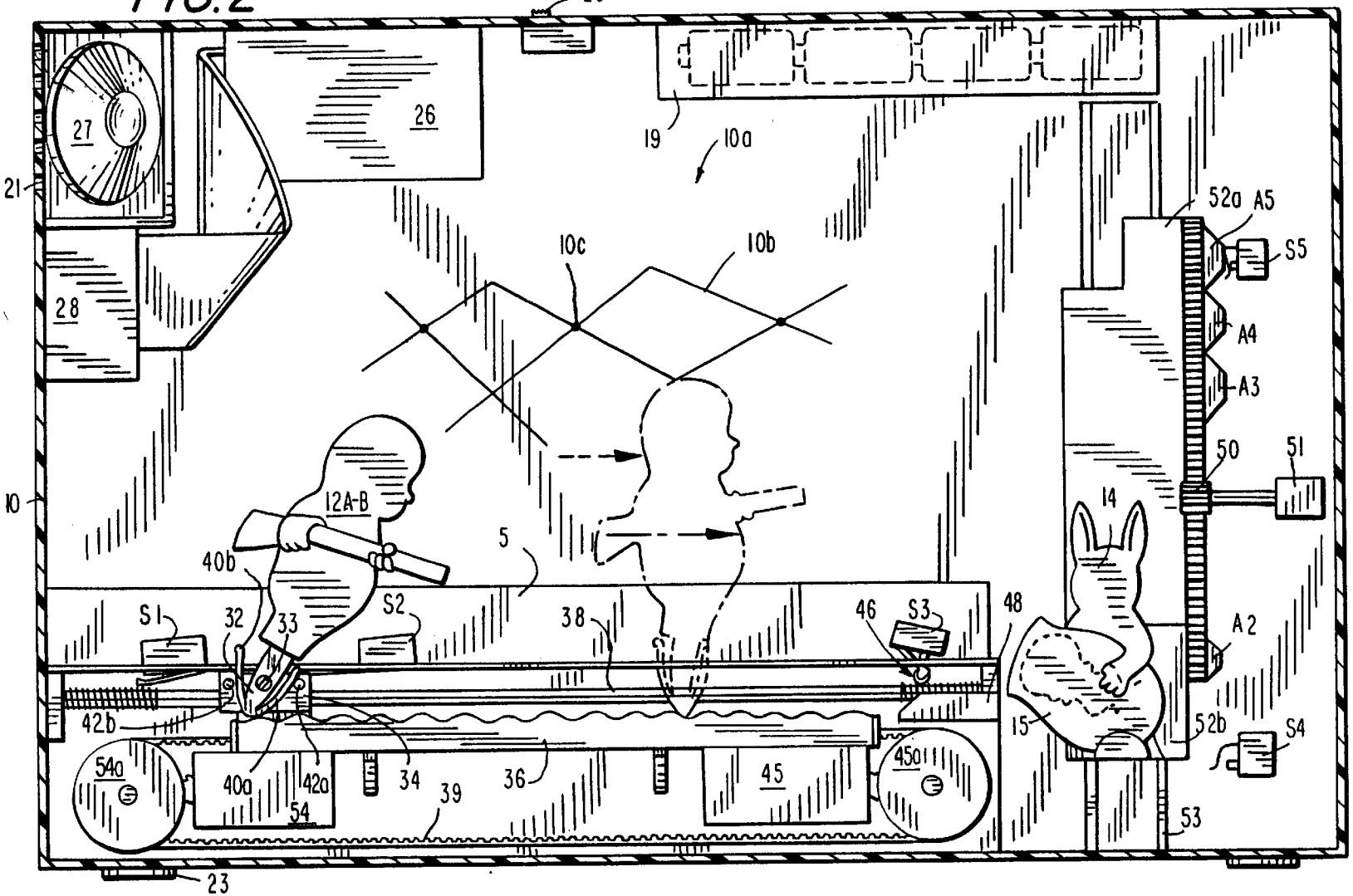
FIG. 2 is a cross-sectional view in the display of FIG. 1 along line II—II.

A first illustrative example of the modular dynamic dialogue animated display device is shown in FIGS. 1 and 2. The modular dynamic dialogue animated display comprises a main assembly including a housing 10 which may be hung on a wall or free standing on a substantially flat surface supported by one or more supporting members, such as feet 23 rotatable from underneath the housing 10. The housing is an open faced box having an interior surface 10*a* opposite its open face. Housing 10 is preferably formed from a moldable material such as plastic and includes an integral raised lattice 10*b* that extends over a portion of the interior surface 10*a* with apertures 10*c* at the points of intersection of the lattice. The main assembly also includes a control unit 26 comprising a central processor U1 and an audio processor U2, each with a corresponding memory or storage device for storing a sequence of storyline events and randomly-accessible audio blocks, respectively, a speaker 27, an audio unit 28, a power source 19, a power switch or button 20 for providing power to the device, and a start switch or button 24 to initiate performance of the storyline. The main assembly is generic, in that its construction is the same regardless of the storyline being depicted, and thus may be inexpensively mass produced.

As shown in FIG. 1, one or more substantially planar stationary scenery layers specific to the storyline being depicted are arranged in the housing 10 and overlaid by a framing mat 18 and a transparent cover such as plexiglass or glass all of which are secured in the housing by a frame 22 appropriately sized to fit around the outside perimeter of the open face of the housing 10. The scenery layers serve a dual purpose in that they provide depth to the diorama and, at times, conceal at least a portion of the sub-assembly from view. The scenery layers shown in FIG. 1 comprise a background layer 16*a*, an intermediate layer 16*b* and a foreground layer 16*c* (including the rabbit hole and the tree). Although three scenery layers are shown, any number of one or more scenery layers may be provided depending on the storyline.

Based on the storyline being depicted, one or more interchangeable sub-assemblies are mounted, preferably via plates 5, to the raised lattice 10*b* of the housing 10 in accordance with the storyline being depicted. The interchangeablity of the sub-assemblies within the universal main assembly provides a further degree or level of modularity to the overall device. Specifically, a variety of sub-assemblies may be mass produced each depicting a different storyline and then secured and electrically connected to the framework of the universal main assembly. This is advantageous in terms of reducing overall time and cost of manufacture.

Each dedicated sub-assembly includes one or more moveable display elements, as for example a character (such as a person or animal) and/or an object (such as a chair or a table), and an associated electromechanical driving mechanism for driving the moveable display element in a substantially planar path of travel substantially parallel to the scenery layers. The entire moveable display element itself may be moved between the scenery layers, for example to depict a clown walking into a circus ring. It is also within the scope of the invention, however, to provide motion to only a portion of the moveable display element, as for example a dog raising its paw or shaking its head. The illustrative example shown in FIG. 1 includes two sub-assemblies hereinafter referred to as the "hunter sub-assembly" which includes a hunter 12 moveable display element and the "rabbit sub-assembly" which includes a rabbit 14 holding a cannon 15 moveable display element. The direction and speed of motion imparted to each moveable display element 12, 14 by the electromechanical driving mechanism is precisely controlled in a time-dependent manner by control signals from the control unit 26 in accordance with the storyline events in order to realistically recreate a cartoon animation storyline. Action of the moveable display elements is synchronized with the playing of selected audio blocks in response to the control signals generated by the control unit 26.

In the example provided the hunter and rabbit moveable display elements are moved separately. Alternatively, two or more display elements may be moved in concert, as for example where two moveable display elements are connected to one another so that movement of one produces a corresponding movement in the other. Most actions may be simulated by moving the moveable display element in a single direction such as a horizontal or vertical direction or, perhaps, radially in a trajectory path or arc. In the illustrative example shown in FIG. 2 the hunter 12 travels along a horizontal path and the rabbit 14 travels along a vertical path. Alternatively, or in addition to movement of the moveable display element in a single direction, realistic and more complex movements may be simulated such as by moving the moveable display element in a series of horizontal and vertical transitions. Any desired movement may be recreated limited only by the construction constraints on the electromechanical driving mechanism required to simulate such movement.

The control unit 26 comprises a central processor U1 including a storyline memory such as a read only memory (ROM) which stores the storyline events. Each storyline event, for example, may comprise action of one of the moveable display elements, lighting of a lamp, and/or playing of a selected audio block of a sound effect, music and/or a segment of speech. Central processor U1 sequences through the stored storyline events and generates appropriate control signals that initiate performance of each event in sequence. The storyline events are sequentially performed. A first storyline event is initiated in response to actuation of the start button 24. Subsequent storyline events are initiated, depending on the particular storyline, upon the passing of a predetermined period of time after initiating the previous storyline event, upon the completion of playing of a selected audio block or upon a moveable display element reaching a predetermined destination position along its path of travel as indicated by actuation of an electronic switch. In a preferred embodiment the central processor U1 operates at clock speeds between approximately 32 kHz and 1 MHz and includes 2 kbytes of 16-bit ROM for storing the sequence of storyline events and approximately 64 bytes of 4-bit scratch-pad RAM for the stacks and working registers used by the software.

Figure 3:
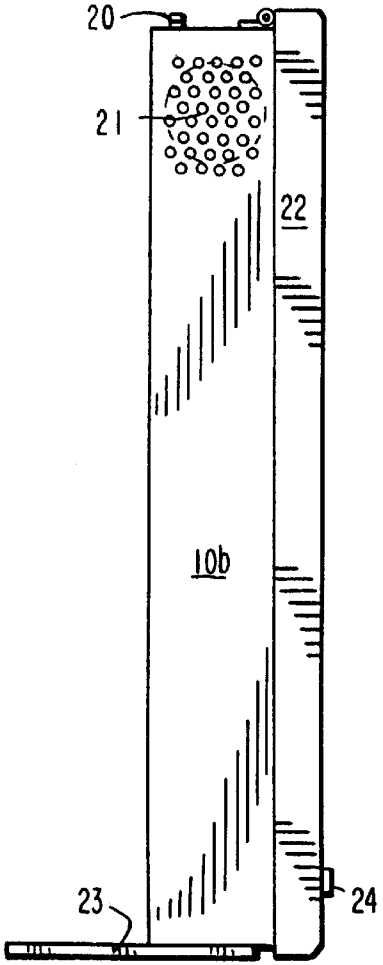
FIG. 3 is a left-side view in the display of FIG. 1 along line III—III.

Control unit 26 also comprises an audio processor U2 including an audio memory which stores randomly-accessible blocks of audio data such as segments of speech, sound effects and/or music. In the example shown the audio memory is a ROM with approximately 512 kbits of stored audio data corresponding to approximately 21 seconds of audio. Of course, however, the audio processor may store any number of seconds of stored audio provided a sufficient number of bits of ROM is provided. The audio processor U2 receives control signals and transducer parameters from the central processor U1 and in response thereto selects a particular block of audio data. Sound is provided by a speaker 27 connected via an audio unit 28 to the audio processor U2. Audio unit 28 provides volume-control and converts digital audio data selected from memory by the audio processor U2 to an analog signal for driving the speaker 27. Sound generated by the speaker 27 is output through a grating 21 in the housing 10, as shown in the side-view in FIG. 3. Using masks, the storyline memory of the central processor U1 and the audio memory of the audio processor U2 are pre-programmed for the particular storyline to be depicted. In a preferred embodiment, processors U1 and U2 are two integrated circuits on a single dual integrated package, as for example chip W52184 or W52188 manufactured by Winband Electronics. Alternatively, processors U1 and U2 may be separate chips such as W74110 and W52542 also manufactured by Winband Electronics.

Action of the moveable display elements is initiated by the central processor U1 and, depending on the pre-programmed sequence of storyline events, is terminated upon actuation by a moveable display element of an electronic switch mounted to the plate of the respective sub-assembly in the path of travel or upon the completion of the playing of a selected audio block. In FIG. 1, switches S1, S2, S3 sense the position of the hunter 12 and trigger events as the hunter travels in a horizontal direction. Similarly, switches S4, S5 sense the position of the rabbit 14 and trigger events as the rabbit travels in a vertical direction. In a preferred embodiment, central processor U1 polls an N×N matrix of switch lines, where N is the number of switches in order to monitor the position of the moveable display elements. Preferably, a main-loop pulse operating at approximately 100 kHz is used for polling the switches to determine the location of the moveable display elements.

The first storyline event is initiated in response to the user actuating the start button. Subsequent storyline events are initiated, depending on the pre-programmed sequence of storyline events, after a predetermined delay period has elapsed, upon the completion of the playing of a selected block of audio data, after a predetermined period of time since initiation of the previous storyline event, and/or movement of the moveable display element to a predetermined position along the path of travel as indicated by closure of a switch at the predetermined location.

Each sub-assembly has an electromechanical driving mechanism for driving the moveable display element using one or more motors. It will be appreciated, however, that the electromechanical driving mechanisms described with reference to the examples shown in the figures are for illustrative purposes only. Each electromechanical driving mechanism may be uniquely constructed based on such design factors as the direction and/or speed of movement necessary to recreate a desired action.

The hunter 12 travels between three positions A, B, C and corresponding electronic switches S1, S2, S3, respectively. Hunter 12 is attached to a cam follower 32 which, in turn, is mounted about a pivot 33 to a carriage 34. Carriage 34 and hunter 12 travel as a single unit on a support rail 38 and are driven by a drive belt 39. The carriage 34 includes an actuation member A1 projecting from the carriage 34 such that the actuation member engages switches S1, S2, S3 as the carriage moves along the path of travel. The cam follower 32 is preferably Y-shaped with the pivot 33 positioned at the intersection of the "Y".

Referring to FIG. 2, in operation initially the hunter 12 is in reset position B with the actuation member A1 engaging switch S2. Then the hunter is driven by bidirectional motor 45 and a pulley 45*a* to position A (concealed from view behind foreground scenery layer 16*c*) with the actuation member A1 engaging switch S1. The direction of motor 45 is reversed and the hunter 12 is moved back to reset position B. As the moveable display element travels along the support rail 38 from position B to position C at switch S3 the lower portion of the Y-shaped cam follower follows, in contact with, an undulating cam 36 arranged below the support rail 38. The undulating cam 36 is rippled and thus as the carriage 34 moves along the support rail 38 the cam follower 32 traces the shape of the undulating cam and causes the hunter 12 to "rock" or "wobble" back-and-forth about pivot 33 in the direction of travel. This rocking action realistically simulates the hunter trudging through the forrest in search of the rabbit.

An upper portion of the Y-shaped cam 32 follower comprises two resilient restrictive arms 40*a*, 40*b*. As the hunter 12 travels from the left-hand-side of the display towards the rabbit hole the restrictive arm 40*a* contacts a stop member 42*a* mounted to the carriage 34 and limits the pivotal rocking action of the hunter 12 in order to maintain contact between the cam follower 32 and the undulating cam 36.

Figure 5A:
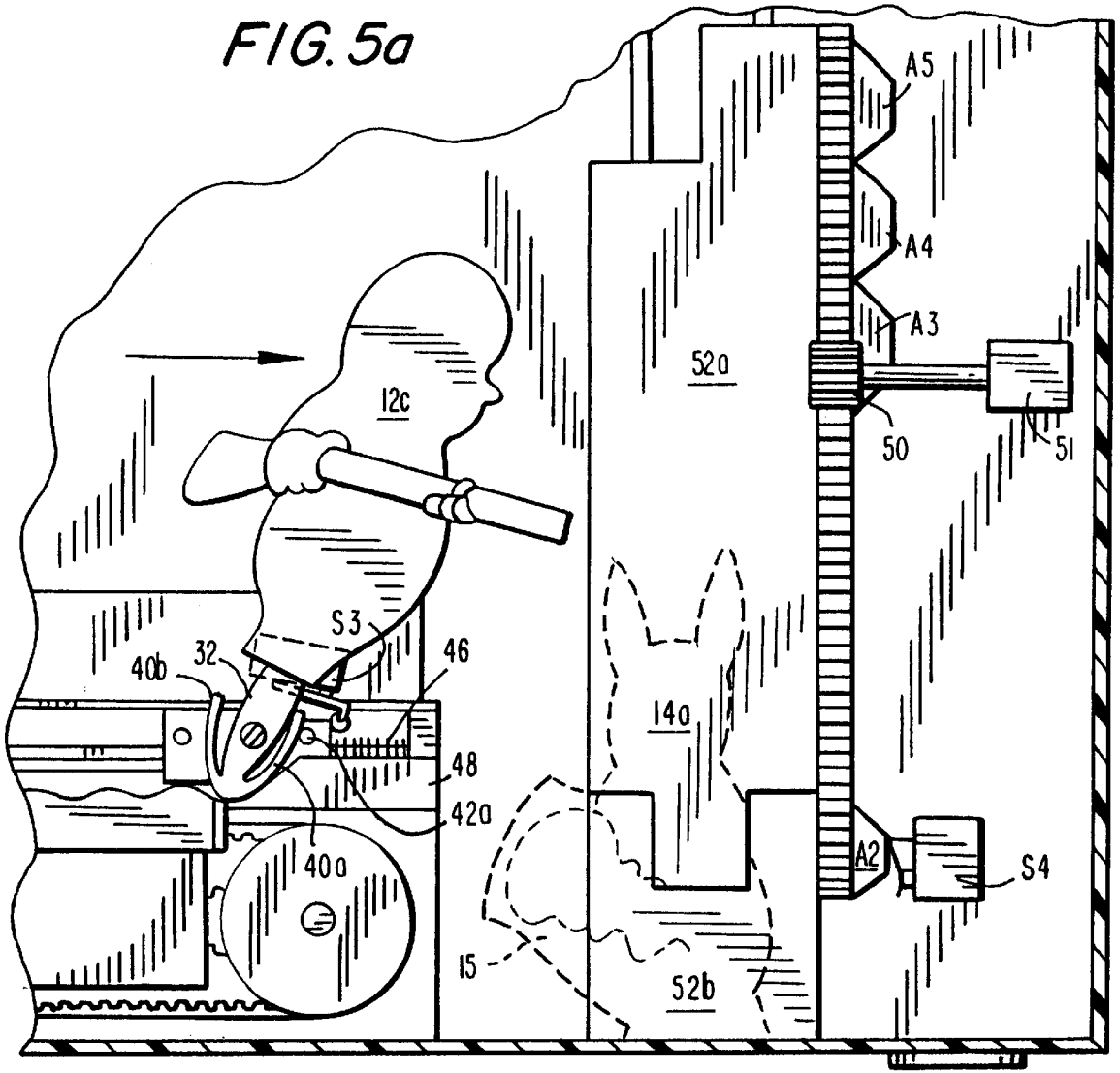
FIG. 5*a* is a partial cross-sectional view of the display of FIG. 1 with the hunter tilted-forward at position C and the rabbit at position A.
Figure 4:
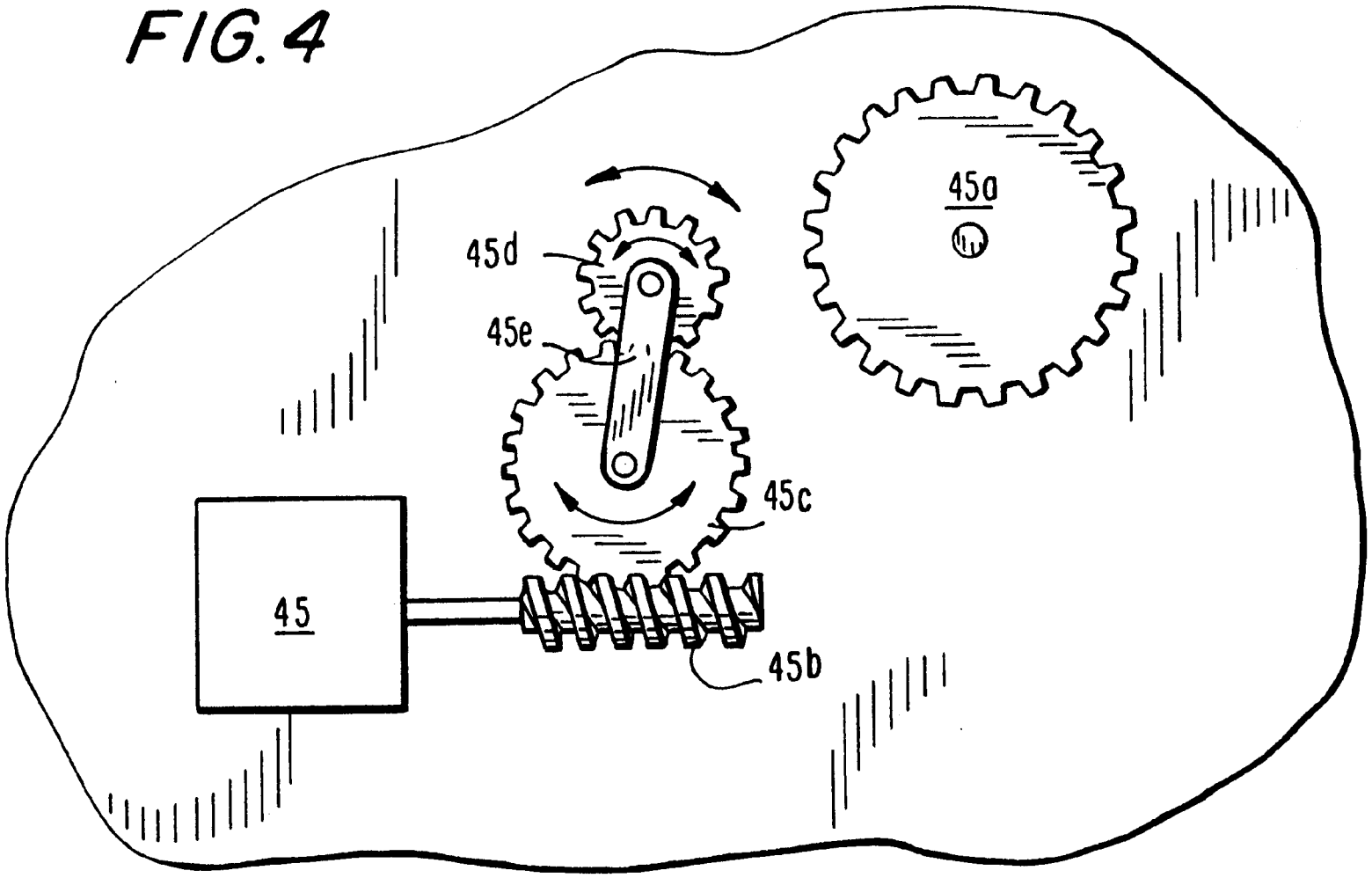
FIG. 4 is a detailed view of the worm gear and planetary idler gear for the motor 45 in the display of FIG. 1.
Figure 5B:
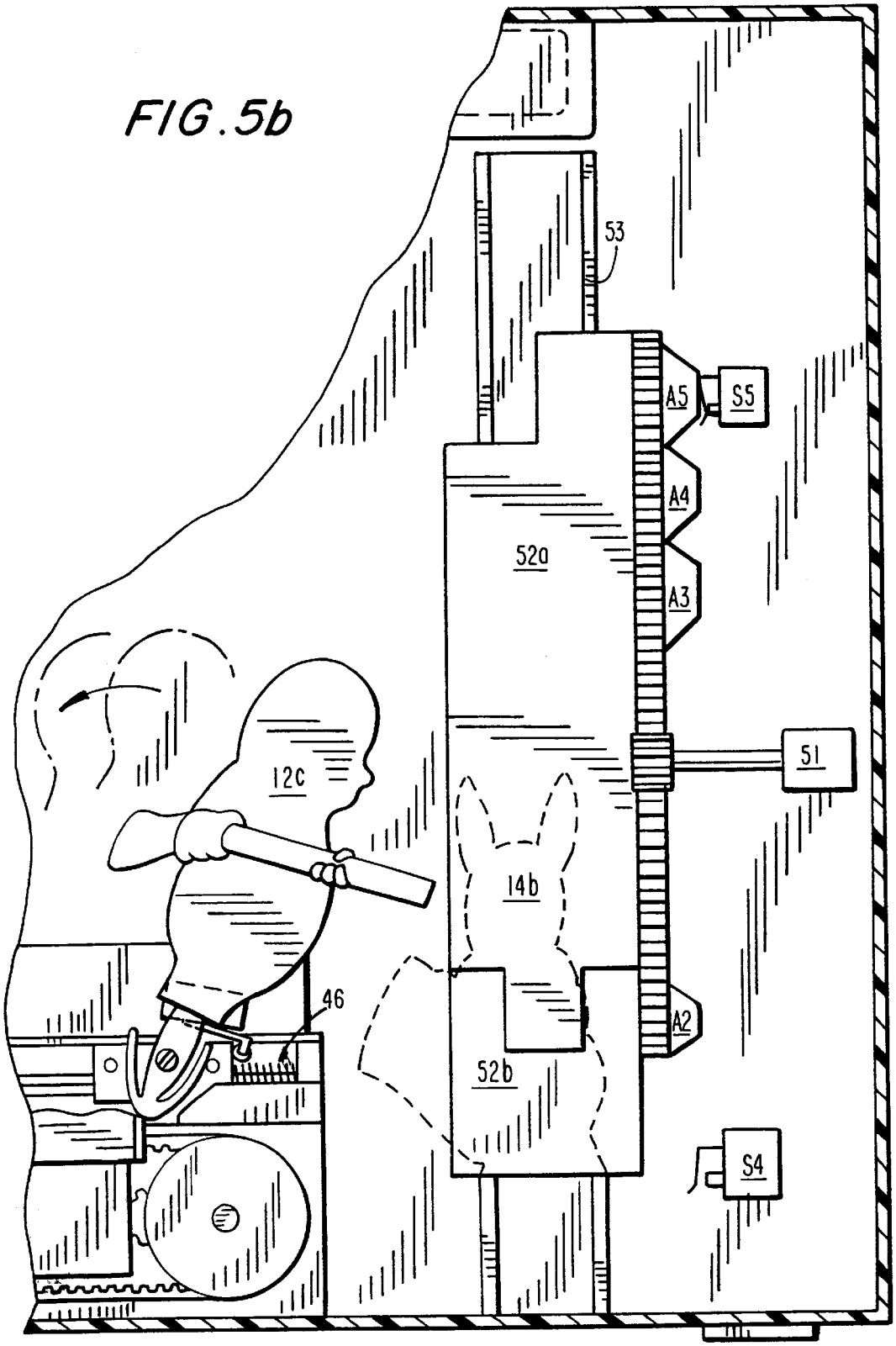
FIG. 5*b* is a partial cross-sectional view of the display of FIG. 1 with the hunter tilted-forward at position C and the rabbit at position B.
Figure 5C:
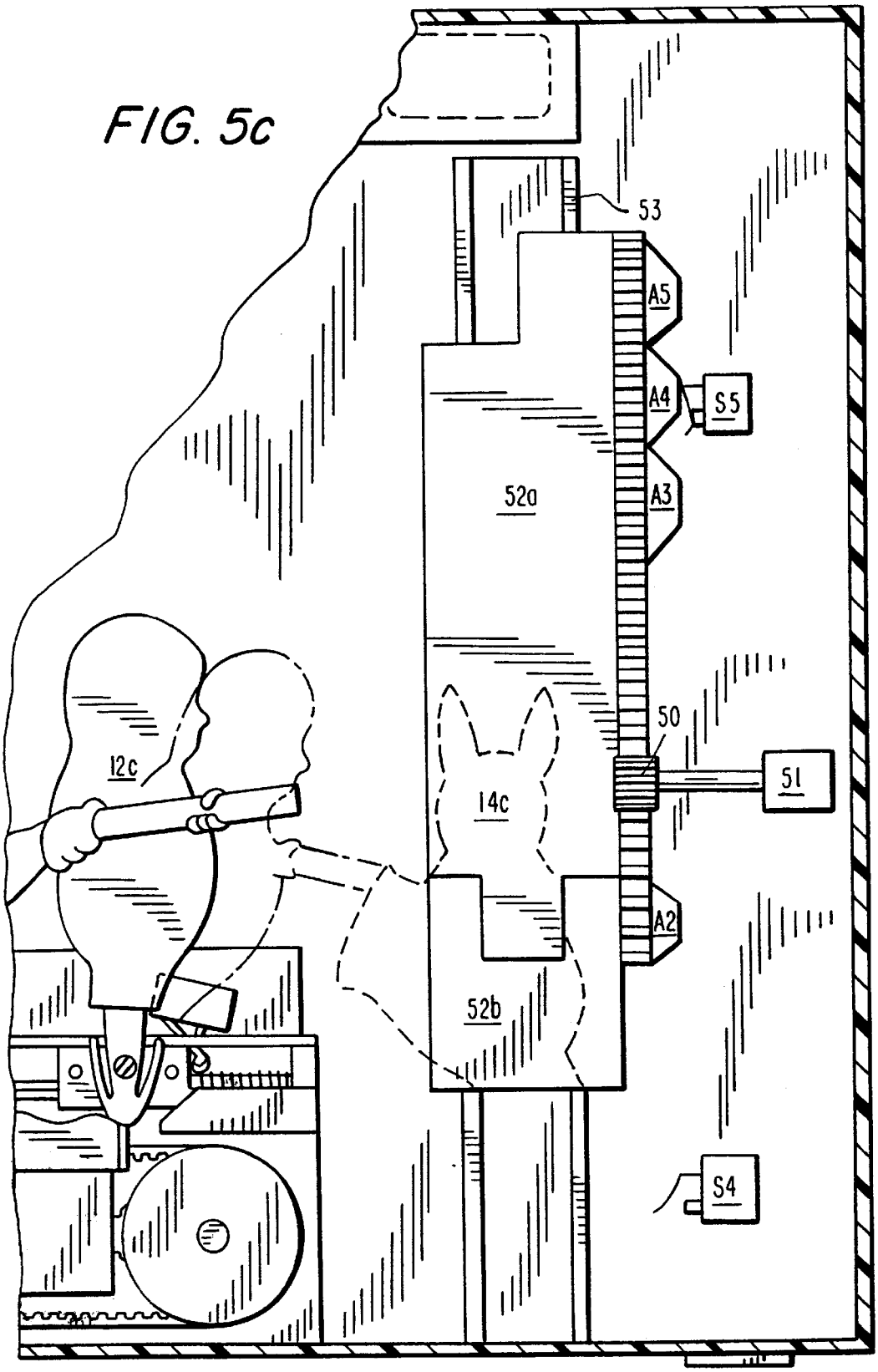
FIG. 5*c* is a partial cross-sectional view of the display of FIG. 1 with the hunter springing from a tilted-forward position to an upright position while at position C and the rabbit at position C.

A multi-purpose bumper spring 46 is disposed proximate the right end of the support rail 38. The bumper spring is multi-functional in that it: (1) allows continued motion of the hunter 12 at the right-hand-side of the display without damage due to overrun after the motor 45 has been switched off, (2) exerts an opposite force to maintain the motor 45 in an engaged state with the hunter in a "leaning forward" position, and (3) pushes the hunter upright when motor 45 is reversed. A leaning stop 48, preferably tilted at an angle of 45° relative to a horizontal axis, is arranged below the support rail 38 and adjacent to the right end of the undulating cam 36. As shown in FIG. 5*a*, when the hunter 12 reaches switch S3 (position C) the carriage 34 compresses the bumper spring 46 as the leaning stop 48 pushes against the lower portion of the cam follower 32 so that the hunter is tilted forward as if to be peering down into the rabbit hole. Motor 45 preferably includes a worm gear drive so that when the carriage reaches position C and the motor 45 is stopped, the hunter remains in a leaning forward position. A detailed view of the motor 45 and worm gear is shown in FIG. 4. As the motor 45 moves the hunter 12 in a forward direction from the left-hand-side (near the tree) to the right-hand-side (near the rabbit hole) of the display it drives the worm gear 45*b* which, in turn, rotates an intermediate gear 45*c* in a clockwise direction so that a planetary idler gear 45*d* engages the right pulley 45*a*. Thus, when the carriage 34 reaches position C at switch S3 and the motor 45 is not energized, the planetary idler gear 45*d* remains "locked" and engaged with the pulley 45*a* so that the cam follower is maintained in a tilted-forward position against the leaning stop 48 with the bumper spring 46 in the compressed state. Counterclockwise rotation of intermediate gear 45*c*, achieved by reversing the direction of the motor 45 and rotation of the worm gear 45*b*, disengages the planetary idler gear 45*d* from the pulley 45*a* and releases the bumper spring 46 whereby the hunter 12 springs into an upright position, as shown in FIG. 5*c*.

Figure 5D:
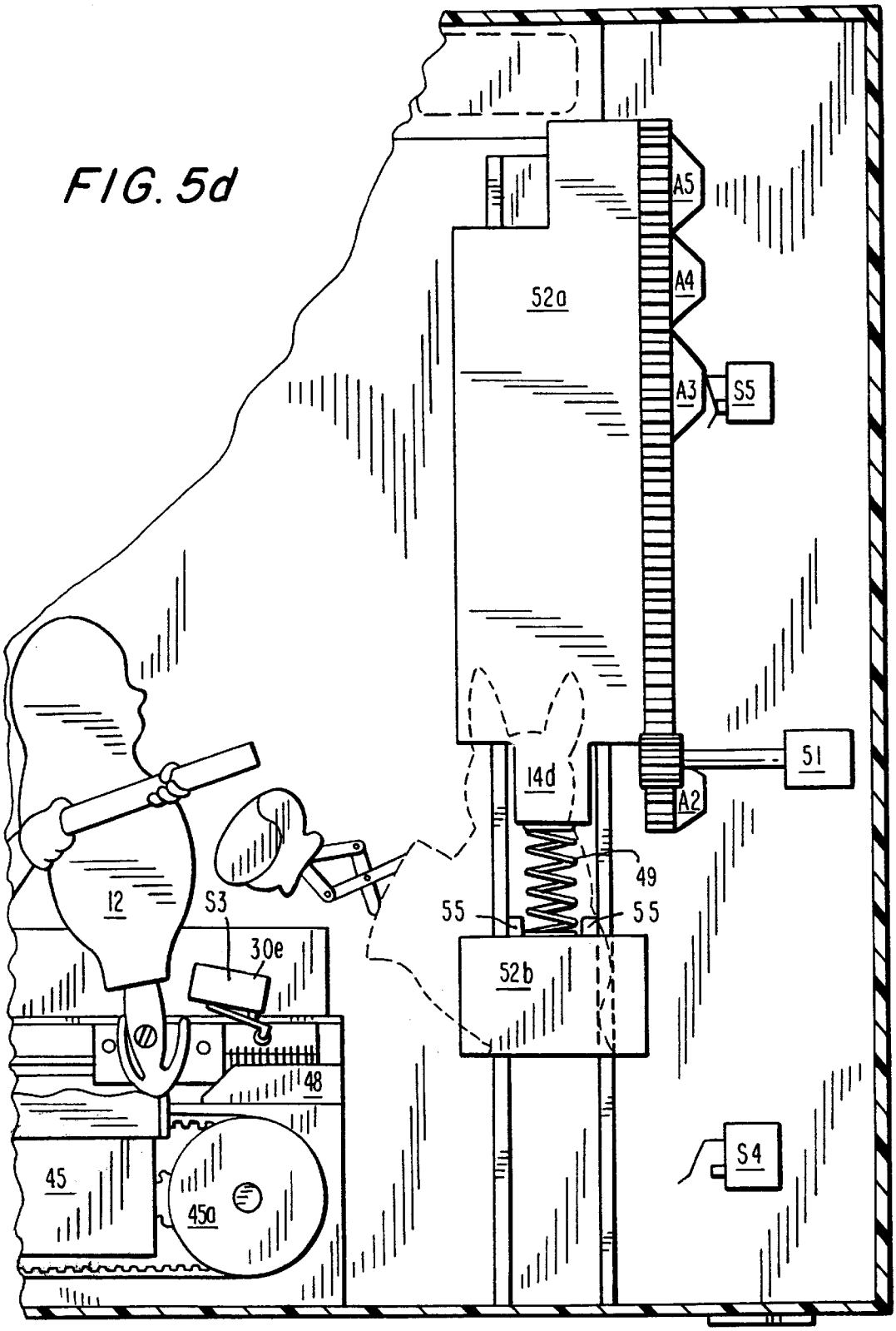
FIG. 5*d* is a partial cross-sectional view of the display of FIG. 1 with the hunter in a leaning backwards position during retrace and the rabbit at position D with the glove extended from the cannon.

Reverse or return movement of the hunter 12 from position C (at switch S3) back to position B (at switch S2) is achieved using a unidirectional motor 54, higher in speed relative to motor 45, and a pulley 54*a*. More complex action of the moveable display elements may therefore be realized by using motors operating at different speeds to drive the hunter 12 depending on the direction of travel. During this return action the restrictive arm 40*b* contacts a stop member 42*b* that limits how far the hunter tilts backwards, as shown in FIG. 5*d*.

Positioned to the right of the hunter sub-assembly is the rabbit sub-assembly which comprises the rabbit 14 moveable display element mounted to a carriage 52*b* that travels on a support rail 53. The rabbit 14 is shown throughout the figures as holding a cannon 15. A vertical rack 52*a* is disposed above the carriage 52*b*. FIGS. 8*b* and 8*c* show front and side views, respectively, of the vertical rack 52*a*. The rack 52*a* and carriage 52*b* are connected to one another by a coil spring 49 and together they move in a vertical direction along the outside of the support rail 53 driven by a pinion gear 50 and a bidirectional motor 51. The coil spring 49 allows the rack 52*a* to rise vertically upwards even after the carriage 52*b* is stopped.

The rabbit 14 travels between four positions A, B, C, D using two switches S4, S5 and four actuation members A2, A3, A4, A5 projecting outwardly from the right-hand side of the rack 52*a*. Using multiple actuation members in this manner reduces the number of electronic switches and overall cost of manufacture. The rabbit 14 is shown in FIGS. 5*a* through 5*d* at positions A, B, C, D, respectively. Initially, as shown in FIG. 5*b*, rack 52*a* and carriage 52*b* are in reset position B with switch S5 engaged by actuation member A5 wherein only the rabbit's head is visible from behind the scenery layers. Then, the rack 52*a* and carriage 52*b* together are moved downward by motor 51 to position A, as shown in FIG. 5*a*, with switch S4 engaged by actuation member A2 so that the rabbit is concealed from view by the foreground scenery layer 16*c*. Next, the rack 52*a* carriage 52*b* return to reset position B, as shown in FIG. 5*b*. From position B the motor 51 drives the rack 52*a* and carriage 52*b* upwards along the support rail 53 to position C, as shown in FIG. 5*c*, with switch S5 engaged by actuation member A4 wherein the rabbit and cannon are fully visible to the viewer. The motor 51 continues to drive the rack 52*a* upwards to a position D, as shown in FIG. 5*d*, with switch S5 engaged by actuation member A3, whereby the glove is extended out from the cannon 15*a*. As the rack 52*a* moves upwards from position C to position D, the carriage 52*b* is held at position C by carriage stopping members 55 disposed along the inside of the rails 53 and the coil spring 49 is extended.

Separation of the rack 52*b* from the carriage 52*a* as the rabbit moves from position C to position D actuates a mechanical glove assembly that ejects the glove out from behind the cannon. The glove assembly, shown in FIG. 8*a*, comprises a front plate 60 mounted to the carriage 52*b*, and a back plate 65 attached substantially parallel to the front plate. A slot 75 is defined in the back plate 65 which receives a pin 70 projecting from a vertically displaceable gear 80. The pin 70 extends through the slot 75 of the back plate 65 and is received by a hole 85 defined in a displacing member 90 of the rack 52*a*, as shown in FIGS. 8*b* and 8*c*. Interposed between the front and back plates 60, 65 is an intermediate rotating gear 95, having a first set of teeth 100 disposed along an outer circumference of the gear and a second set of teeth 105 arranged on a raised smaller inner circumference. The vertically displaceable gear 80 engages the second set of teeth 105 while the first set of teeth 100 engage an angled rack 110 on which the picture of the glove is mounted.

In operation, as the rack 52*a* and displacing member 90 move upwards from position C to position D the pin 70 is vertically displaced in slot 75 which, in turn, moves the vertically displaceable gear 80 upwards. As the vertically displaceable gear 80 moves upwards it engages the second set of teeth 105 and rotates intermediate rotating gear 95. Simultaneously as the intermediate rotating gear 95 rotates the first set of teeth 100 engage the angled rack 110 and actuate the glove out from behind the cannon. In a similar manner when the rack is moved downward from position D to position C the gears operate in reverse movement so that the angled rack 110 is retracted back between the back and front plates and the glove is concealed from view by the cannon. The pin 70 in the hole 85 of the displacing member 90 maintains the coil spring 49 in a compressed state so that the rack 52*a* and carriage 52*b* move together between positions A, B and C. When the rabbit's carriage 52*b* is stopped by the carriage stopping members 55 the coil spring 49 allows the rack 52*a* to continue to move upwards to position D at switch S5.

In a preferred embodiment motor 51 includes a worm gear, which substantially prohibits backwinding of the gear 50 when the motor 51 is not energized so that the glove remains in an extended position, and a clutch to allow overrunning of the motor 51 beyond the rack's 52*a* upper limit when traveling between position C and D, as shown in FIG. 5*d*, without damaging the mechanism. The worm gear is similar to that shown in FIG. 4 with respect to motor 45 and, therefore, will not be described further.

Figures 6A, 6B:
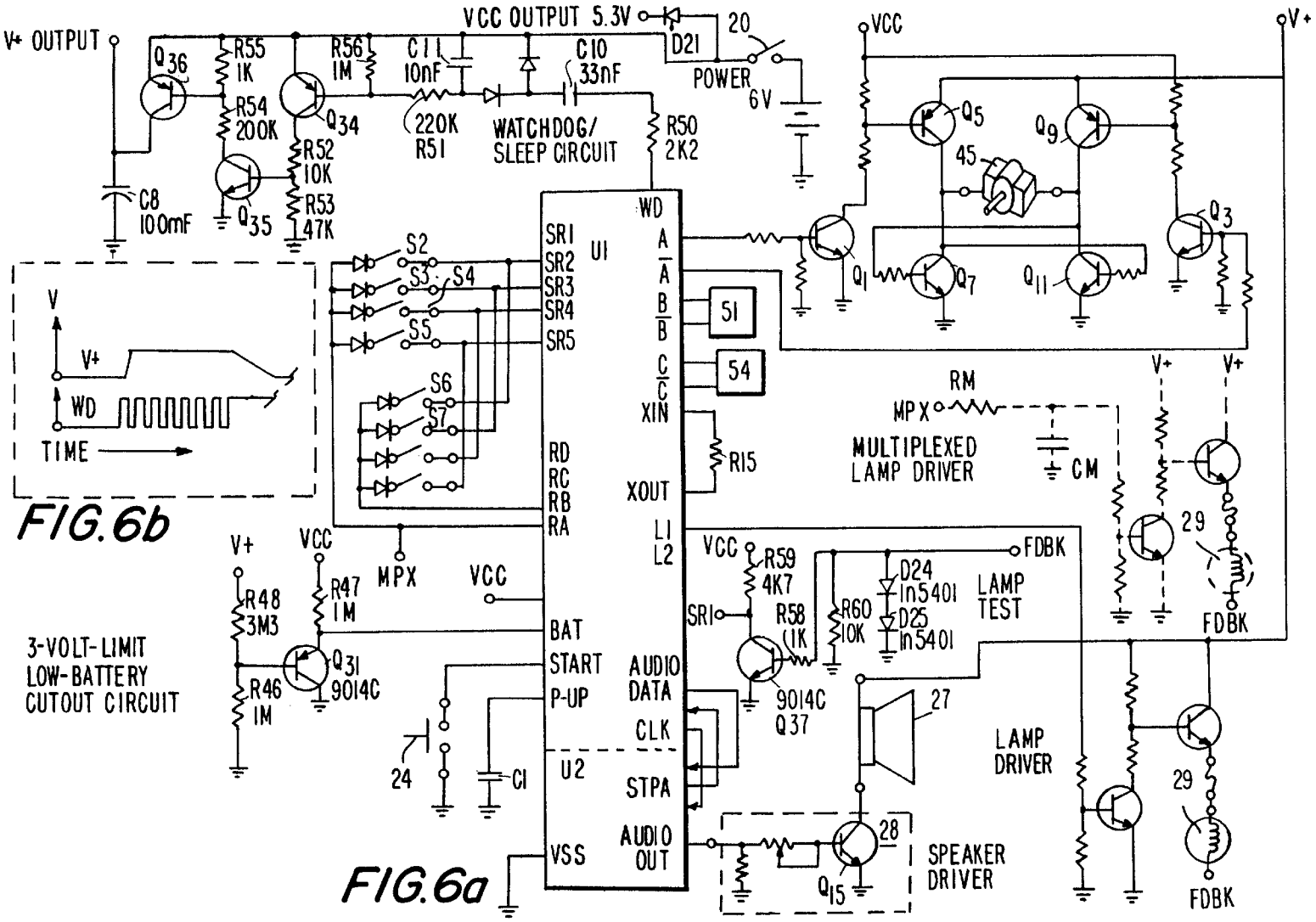
FIG. 6*a* is a circuit diagram of the control unit in the display of FIG. 1.
FIG. 6*b* is a timing diagram for the watchdog/sleep circuit in FIG. 6.

The electronic circuitry for the control unit 26 is shown in FIG. 6*a* including the central processor U1 and audio processor U2. Movement of the hunter 12 and rabbit 14 moveable display elements is achieved by motors 45, 51, 54 actuated by the central processor U1 and limited by the switches positioned along the path of travel of the moveable display elements. Central processor U1 has 3 pins A, B, C which control the motors 45, 51, 54, respectively. A low output at pin A of central processor U1 to control transistor Q1 drives motor 45 and, in turn, the hunter 12 forward, while a low output at pin $\overline{A}$ to control transistor Q3 reverses motor 45 and free wheels its planetary gear, shifting the hunter's pulley 45 to a neutral position. A low output at pin B of central processor U1 drives bidirectional motor 51 and, in turn, the rabbit 14 forward, while a low output at pin $\overline{B}$ reverses motor 51. Similarly, a low output at pin C of central processor U1 enables unidirectional high-speed drive motor 54, which free wheels while bidirectional drive motor 45 drives the hunter 12, and moves the hunter 12 to a reset position A and then returns the hunter to reset position B.

A motor may be damaged if the processor fails to cut off power after an extending period of time. Rather than rely on a circuit breaker to disable each motor after it has overheated, the control unit 26 includes a dual purpose watchdog/sleep circuit, as shown in FIG. 6*a*. The watchdog aspect of the circuit removes the supply voltage $V_+$input to all motors and/or lamps when the control unit 26 malfunctions to prevent further damage to the system. In addition, the sleep feature of the circuit cuts off power supplied to the motor and lamps between storylines to extend the life of the battery. Transistor $Q_{36}$ supplies power to the motor drive transistors. If the program and microprocessor are properly working a pulse is continuously transmitted to keep transistor $Q_{36}$ turned on and power supplied to the motor drivers. If transistor $Q_{36}$ is not turned on power will not be supplied to the motors. Since the circuit is AC coupled through $C_{10}$, power will be supplied to the motors when pulses, and not a steady low or high signal, is output from the watchdog WD port of the central processor U1, as shown in FIG. 6*b*. As a result, if the processor is defective or the program fails, the processor will not generate pulses and the motors will be automatically disabled. Preferably the watchdog pulse is a polling pulse provided on the output MPX, which the watchdog/sleep circuit shares with the multiplexed lamp driver circuit to thereby eliminate WD as a single-purpose output pin. This arrangement maximizes the number of ports available and, therefore, increases the number of control options available for implementing different storylines.

The central processor U1 is shown in FIG. 6*a*, by way of example, as also providing two lamp-control lines and a lamp test line. Alternatively, more than two lamp control lines may be provided. Specifically, the sensor input lines can be programmed to produce control signals, with the addition of a resistance RM and a capacitance CM to each multiplexed lamp driver. A preferred example of the multiplexed lamp driver is shown in FIG. 6*a*, in phantom. The RC smoothing increases the duty cycle of the pin beyond the pulses polling the switch matrix and provides a control signal to the lamp driver circuit.

The audio processor U2 responds to audio block addresses transmitted by central processor U1 by setting high a busy flag on the STPA line to the central processor U1. Central processor U1 retrieves the selected audio blocks from the ROM as serial digital data and transmits the digital data to audio processor U2 which converts the data to an analog signal using a digital-to-analog converter. The analog signal is transmitted to the base of driver transistor Q15 in speaker driver 28 which amplifies the signal and activates the speaker 27. The busy flag to the STPA line goes low when the playing of the selected audio block is finished.

Operation of the first example of the animated display device will now be described with reference to the flow chart shown in FIGS. 7*a* through 7*f*. When the device is powered on it executes a self-monitoring processing sequence that protects the mechanisms of the display and maintains the overall quality of the storyline being depicted. As shown in the flow chart in FIGS. 7*a* and 7*b*, upon actuation of the power switch or button 20 by the user a self-test is initiated by the central processor U1 to check whether the components of the display are in proper working order prior to initiating performance of the storyline. In step 700 the power switch or button 20 is actuated and the audio system is tested by playing a test block of audio information in step 705 without producing any sound. If the audio processor U2 fails to operate or falsely indicates that it is still in the "ready" state while playing the audio data then some type of warning signal is enabled in step 710, as for example by flashing an array of lamps 29. Next, in steps 715–750 the motors 45, 54, 51 are run and a check is made to verify that the switches are operating properly, e.g. open and close in response to action by the moveable display elements along the path of travel. If the result of the sound or switch check is that one or both are not properly working then the processor is disabled in step 760 while the operator corrects the problem.

Next, a lamp and battery check is performed in step 765. If any of the lamps need replacement a warning "Request for replacement" is played in step 770, the processor is disabled and power is turned off in step 775. Each time the display is powered on, the resistance across the lamps 29 is checked using the FDBK line of the central processor U1 connected to each lamp. If the central processor U1 detects a burned out lamp, the processor is disabled and power is cut off until the appropriate bulbs are replaced. At a later time when power is resupplied the display automatically repeats the self-testing and reset processing to verify that all of the lamps are working properly. Similarly, if the power supply (battery voltage) falls below a predetermined threshold, as for example 3 volts, transistor $Q_{31}$ generates a low signal which is received by the central processor U1 at the BAT port. Upon receipt of the low BAT signal the central processor U1 disables the processor and cuts off power to the display. This circuit thus prevents operation of the display when the power supply is so low so to possibly effect the overall quality of the audio and/or action of the moveable display elements. After the batteries have been replaced, when the power switch or button 20 is actuated, the display 10 repeats the self-testing and reset routines before initiating the storyline.

In steps 780–810 the positions of moveable display elements 12, 14 are checked to see if they are in reset position B. If the moveable display elements are not in reset position B then they are moved to position A and then to position B. A timeout check is performed in steps 790, 805 to prevent damage to the motor in the situation where the electromechanical driving mechanism is stuck. If the moveable display element does not reach position B within a predetermined timeout processing period following initiation of movement, then the processor is disabled and power is cut off. As a last step in the self-test routine if all of the moveable display elements are in their reset position B then the display is powered down and awaits activation of the start button or switch 24.

Thereafter, another reset routine is performed when the user actuates the start button or switch 24 to begin the storyline. In step 815 of FIG. 7*c*, in response to the user actuating the start button or switch 24 a check is made in step 820 to verify that the moveable display elements 12, 14 are in reset position B. If the moveable display elements 12, 14 are not in reset position B then reset processing is performed in steps 825–835 in which the moveable display elements are moved to position B; otherwise, if the moveable display elements are in position B then the audio unit 28 is repeatedly checked in step 840 until it is "ready" to play the first block of audio data. When the audio unit 28 is "ready" in step 845 "intro" music is played. Reset processing is important for precisely synchronizing action of the moving elements because the movable display elements, each with their corresponding range of possible positions, might be displaced when the display is moved or dropped. Also, since the start button or switch 24 may be actuated while a previously-initiated storyline is still in progress, the central processor U1 verifies that the audio unit 28 is "ready" to play the first block of audio data. The power-on self-test routine and the reset processing is a self-correcting feature of the display in that movement of the moveable display elements and actuation of the switches during this processing may dislodge small particles and/or dust which has accumulated since last operating the display that might otherwise interfere with proper operation of the display.

Figure 7A:
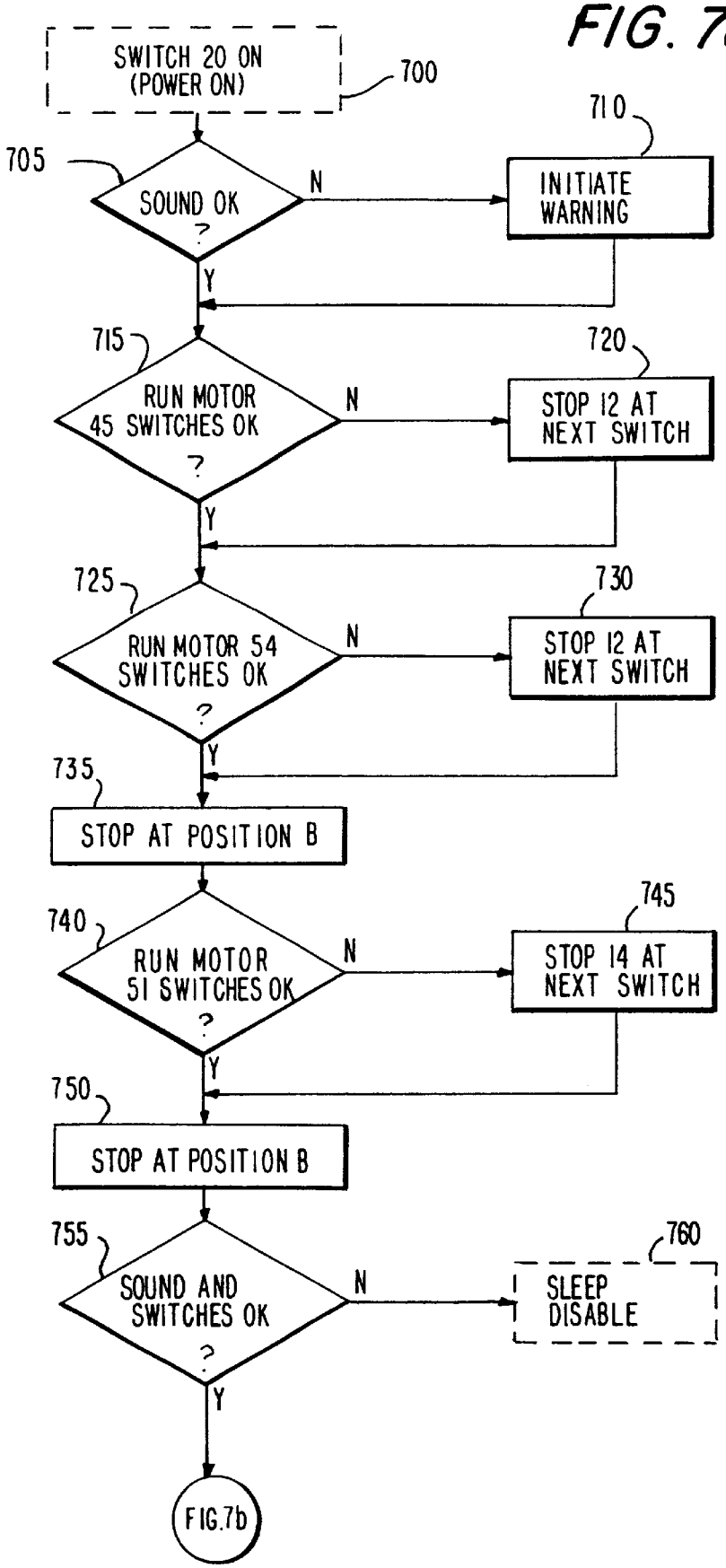
FIGS. 7*a* through 7*g* are operational flowcharts of the display of FIG. 1.
Figures 7A, 7B:
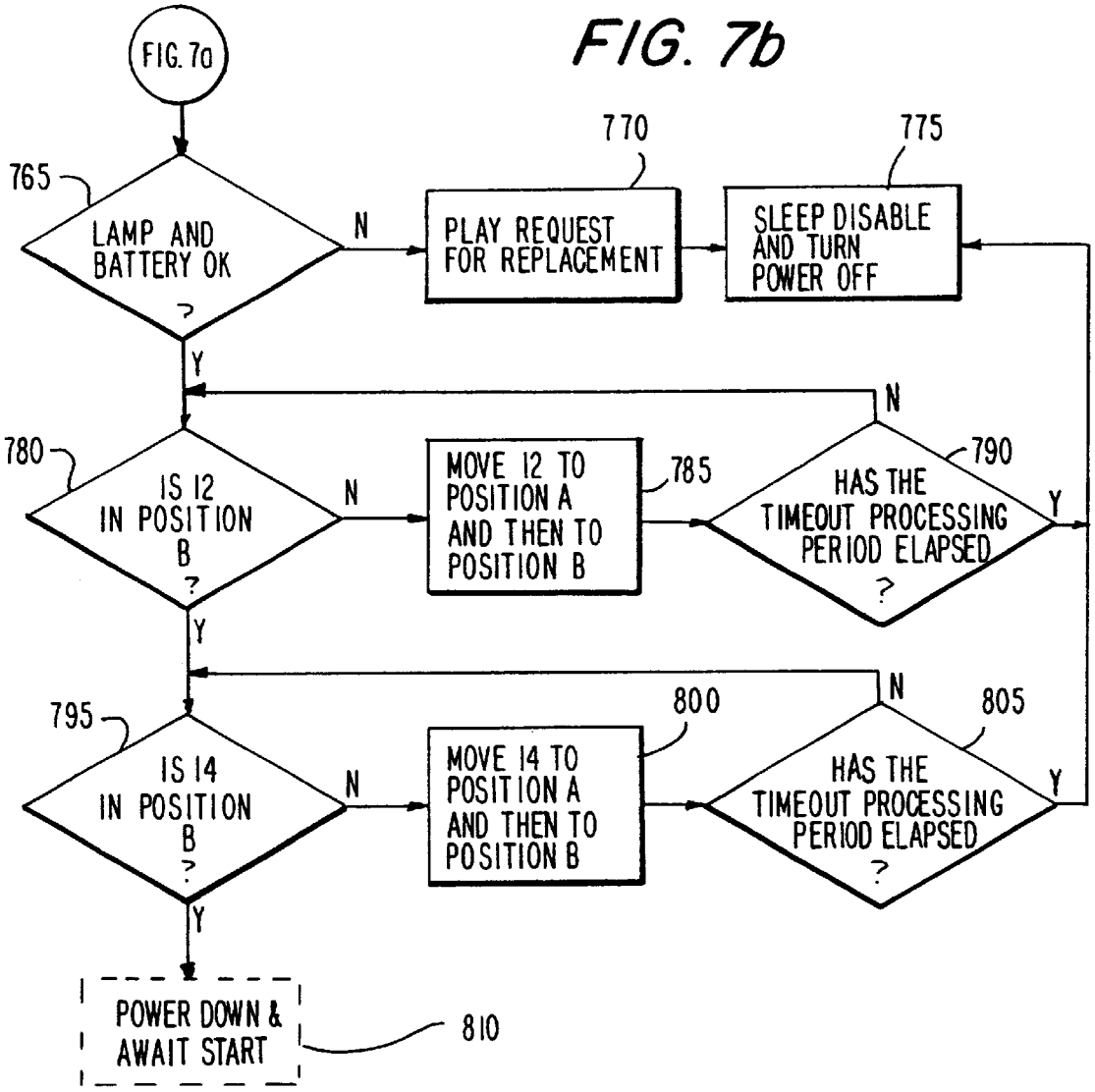
Figures 7C, 7D:
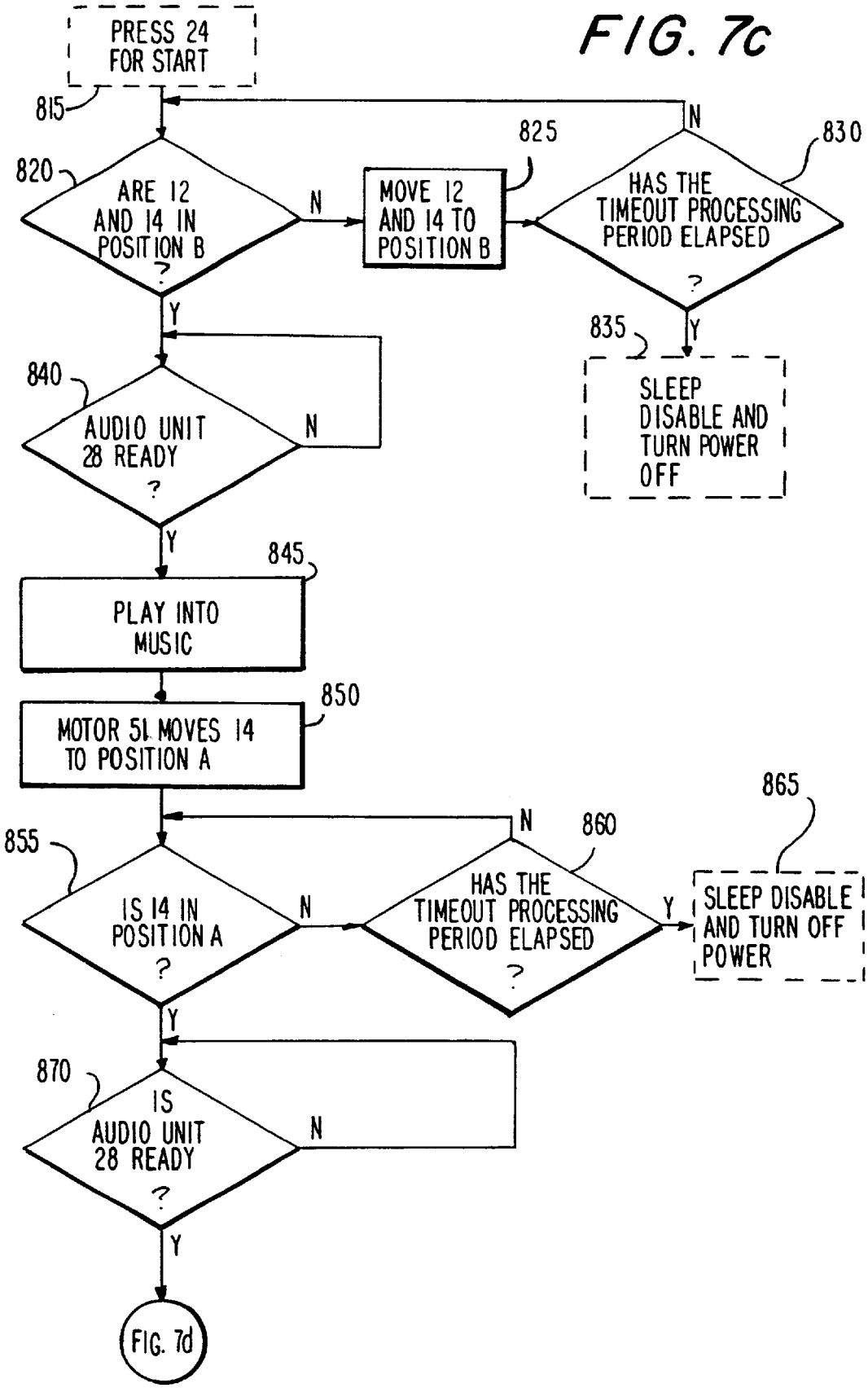
Figure 7D:
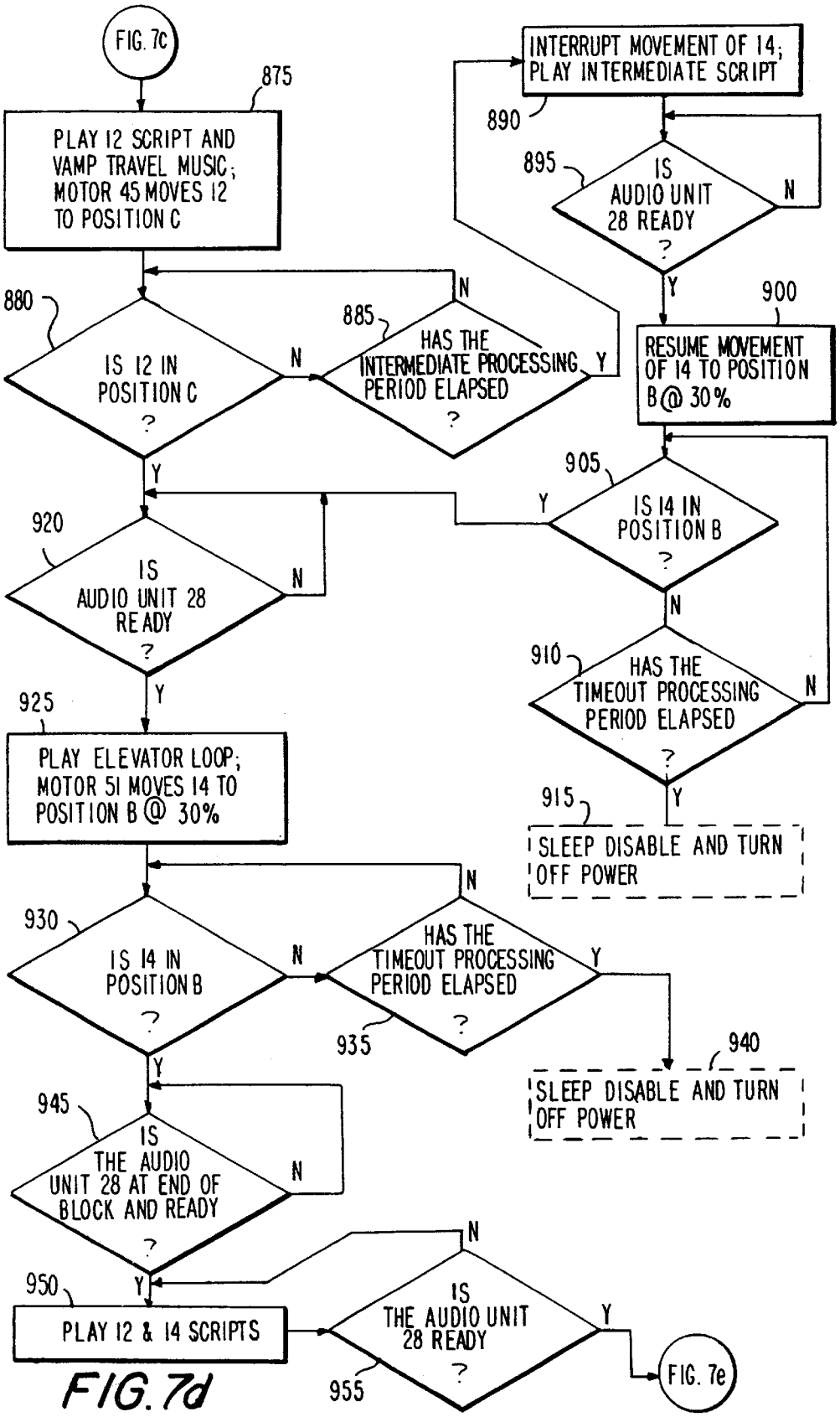

In steps 850–865 of FIG. 7*c*, while the "intro" music plays, the rabbit 14 is moved downward from the reset position B with actuation member A5 engaging switch S5 to a position A with actuation member A2 engaging switch S4 wherein the rabbit 14 is concealed behind the rabbit hole foreground layer 16*c*. The next action is not initiated until in step 870 the audio block is finished playing as indicated when the audio unit 28 is "ready" to play the next audio block.

Block 860 is a timeout processing check that is performed each time a moveable display element is moved between two positions. The timeout processing check is used detect when a moveable display element is stuck in order to interrupt movement prior to the motor overheating. A check is made to determine whether or not a predetermined timeout processing period has elapsed since the initiation of movement of the moveable display element, e.g. movement of the rabbit 14 from position B to position A. If the time period since initiating a given movement of a moveable display element (e.g. the time since initiating movement from position B towards position A) exceeds the predetermined timeout processing period then movement of the moveable display element is interrupted, the processor is disabled and power is cut off. A similar check is performed for each action of the moveable display element and thus will not described with respect to each particular action.

In the next movement sequence provided in steps 875–920 the hunter 12 is driven by motor 45 to position C at switch S3 while audio unit 28 plays travel music and a voice of the hunter mumbling to himself about the rabbit. As the hunter travels along the support rail 38 towards the rabbit hole the cam follower 32 of the hunter 12 follows the undulating cam 36 and causes the hunter 12 to rock forwards and backwards as if "trudging" along towards the rabbit hole. Because the friction produced as the cam follower 32 follows along the undulating cam 36 results in considerable variability in travel time, the music and mumbling sounds simultaneously played while the hunter 12 is moved from position B to position C are preferably stored as a continuously looped audio block.

In the example provided the hunter 12 will not reach position C before an intermediate processing period has elapsed in step 885. In step 890 when the intermediate processing period elapses movement of hunter 12 is interrupted and an intermediate "startled" sound effect is played to indicate that the hunter has seen the rabbit 14. After completion of the playing of the sound effect in step 895, in step 900 the processor once again resumes movement and audio where it left off. This intermediate processing period check is advantageous in that it provides another means aside from the electronic switches for controlling the action of the moveable display elements and synchronized audio. An intermediate processing period check may be performed in a similar manner for any given movement of a moveable display element. Thus, it is contemplated and within the intended scope of this invention to set a predetermined intermediate processing period and intermediate audio block to be played based on the desired storyline being depicted. While the movement of the moveable display element is resumed after completion of playing the intermediate audio block, a timeout processing check is performed in steps 905–915 as previously described.

In step 880, when the hunter 12 reaches position C at the right-hand-side of the support rail 38, the bumper spring 46 is compressed by the carriage 34 and the continuous loop of mumbling sounds and traveling music is interrupted. After the carriage 34 reaches position C and actuates switch S3, the motor 45 is dengergized and the worm gear 45*b* holds the carriage 34 against the bumper spring 46 and the hunter 12 against the leaning stop 48 in a tilted-forward position as if peering down into the rabbit hole, as shown in FIGS. 5*a* and 5*b*.

The hunter 12 remains held in this leaning position while the rabbit 14 is driven by motor 51 from position A with actuation member A2 engaging switch S4 to position B with actuation member A5 engaging switch S5. In steps 925–945 an "elevator" sound effect ending with a distinctive "trailing" sound effect is played as the rabbit slowly emerges from his hole driven by motor 51 operating at a reduced duty cycle, preferably at approximately 30%, for dramatic effect. It is preferred to control the speed of movement or action in different parts in accordance with the storyline by varying the duty cycling of the motor using the central processor U1, i.e. by slowing the effective motor speed by turning power to the motor on/off at different frequencies. The longer the power is on the faster the speed of the motor until the motor is running at its rated speed for that particular voltage. On the other hand, the longer the power is off the more the speed of the motor decreases.

In steps 950–955 the hunter 12 and rabbit 14 engage in an interactive dialogue.

Then, in steps 960–975 the rabbit 14 is moved from position B with actuating member A5 engaging switch S5 to position C with actuation member A4 engaging switch S5 thereby revealing to the hunter 12 that the rabbit 14 is holding a cannon 15*a*. At the moment the hunter 12 "sees" the cannon 15*a* a dramatic "startle" reaction is achieved as motor 45 is abruptly reversed releasing the bumper spring 46 which, in turn, pushes the hunter 12 away from the leaning stop 48 into an upright position, as shown in FIG. 5*c*. Specifically, the reversed direction of the motor 45 rotates the worm gear drive in a counterclockwise direction and causes the planetary idler gear 45*d* to disengage from the pulley 45 thereby releasing the bumper spring 46 so that the hunter 12 springs upright without being displaced along the support rails 38.

The dramatic "startled" reaction achieved in step 960 by releasing the worm gear that holds the hunter 12 in the leaning position shown in FIGS. 5*a* and 5*b* also prepares the hunter 12 for his subsequent high-speed return trip back to position A at switch S1, driven by unidirectional motor 54. A sufficient amount of time is provided for the planetary gear 45*d* to rotate a sufficient distance away from the pulley 45*a* to allow free-wheeling. In addition, an adequate amount of delay must be provided to reverse the direction of the spring-loaded cam-follower 32 from leaning towards the rabbit hole to the opposite slant, depicting headlong retreat. If a sufficient amount of time is not allowed the cam-follower 32 will jam against the surface of the undulating cam 36 during retreat. Precise processor control of the motor operation in this manner realistically expresses the hunter's surprise while preventing or substantially reducing the occurrence of jamming, which might otherwise result when the hunter 12 is pulled backward at relatively high speed from the tilted-forward position.

In step 980, before moving further upwards to position D, the rabbit 14 remains for an extended period of time, preferably approximately 0.2 seconds, in position C with actuation member A4 engaging switch S5. After this delay has elapsed, in steps 985–1005 the rabbit 14 is moved by motor 51 from position C with actuation member A4 engaging switch S5 to position D with actuation member A3 engaging switch S5. At position C the carriage 52*b* is stopped by the carriage stopping members 55 but the rack 52*a* continues to rise past the pinion gear housing 50 until reaching position D with actuating member A3 engaging switch S5 thereby actuating the glove out from behind the cannon.

As the glove is actuated from the cannon in steps 1010–1015 a corresponding "punching" sound effect is generated by the audio unit 28. Simultaneously, in steps 1020–1035 the bi-directional motor 45 free-wheels and a uni-directional clutch on the high-speed pulley 54*a*, which previously allowed that pulley to free-wheel while the hunter 12 was driven by the bi-directional motor 45, is engaged.

Once the uni-directional clutch on the high-speed pulley 54*a* is disengaged, the uni-directional motor 54 jerks the hunter 12 from position C at switch S3 back toward position A at switch S1. To prevent damage occurring as a result of the relatively high-speed collision between the carriage 34 and the end of the support rails 38 when the hunter 12 reaches position A at switch S1, in step 1040–1055 pulse-width modulation is employed by central processor U1 in order to slow the retrace of the hunter 12 at the end of his trajectory, after passing position B and actuating switch S2. In a preferred embodiment, actuation of switch S2 causes the central processor U1 to vary the power supplied to the high-speed retrace motor 54 to 500 Hz with a 30% duty cycle in order to slow the rotation of the high speed pulley 54*a* and, in turn, reduce the speed of retrace of the hunter 12.

The hunter 12 disappears behind the foreground layer 16*c* and upon reaching position A at switch S1, in steps 1060–1065 the audio unit 28 plays a "crash" sound effect. After the crash the hunter 12 recites an epilogue in steps 1070–1075 and "finale" music is played in step 1080.

As the "finale" music plays, in steps 1085–1100 the motor 51 returns the rabbit 14 to position A where the rabbit disappears away from sight into his hole concealed behind the foreground layer 16*c*. Thereafter, in steps 1105–1120 the motor 51 moves rabbit 14 back to position B for his curtain call. After a dignified pause of preferably 0.5 seconds in step 1125, the hunter 12 likewise is returned to position B for his curtain call by motor 45 in steps 1130–1150. The storyline is now complete and the display is powered-down awaiting the next actuation of the start switch or button 24 in step 1155.

Figure 9:
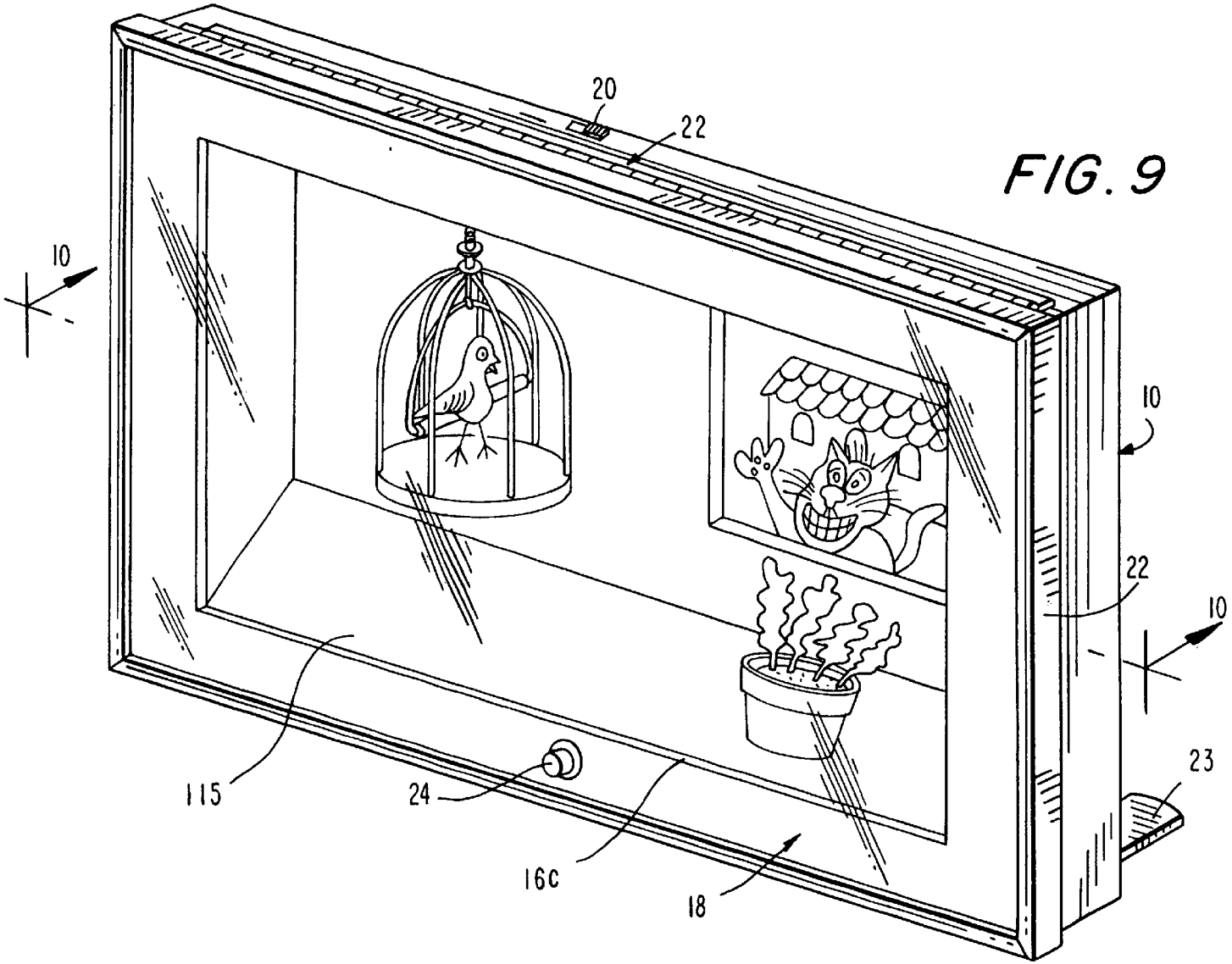
FIG. 9 is a plan view of a second example of the modular dynamic animated display according to the present invention.
Figure 10:
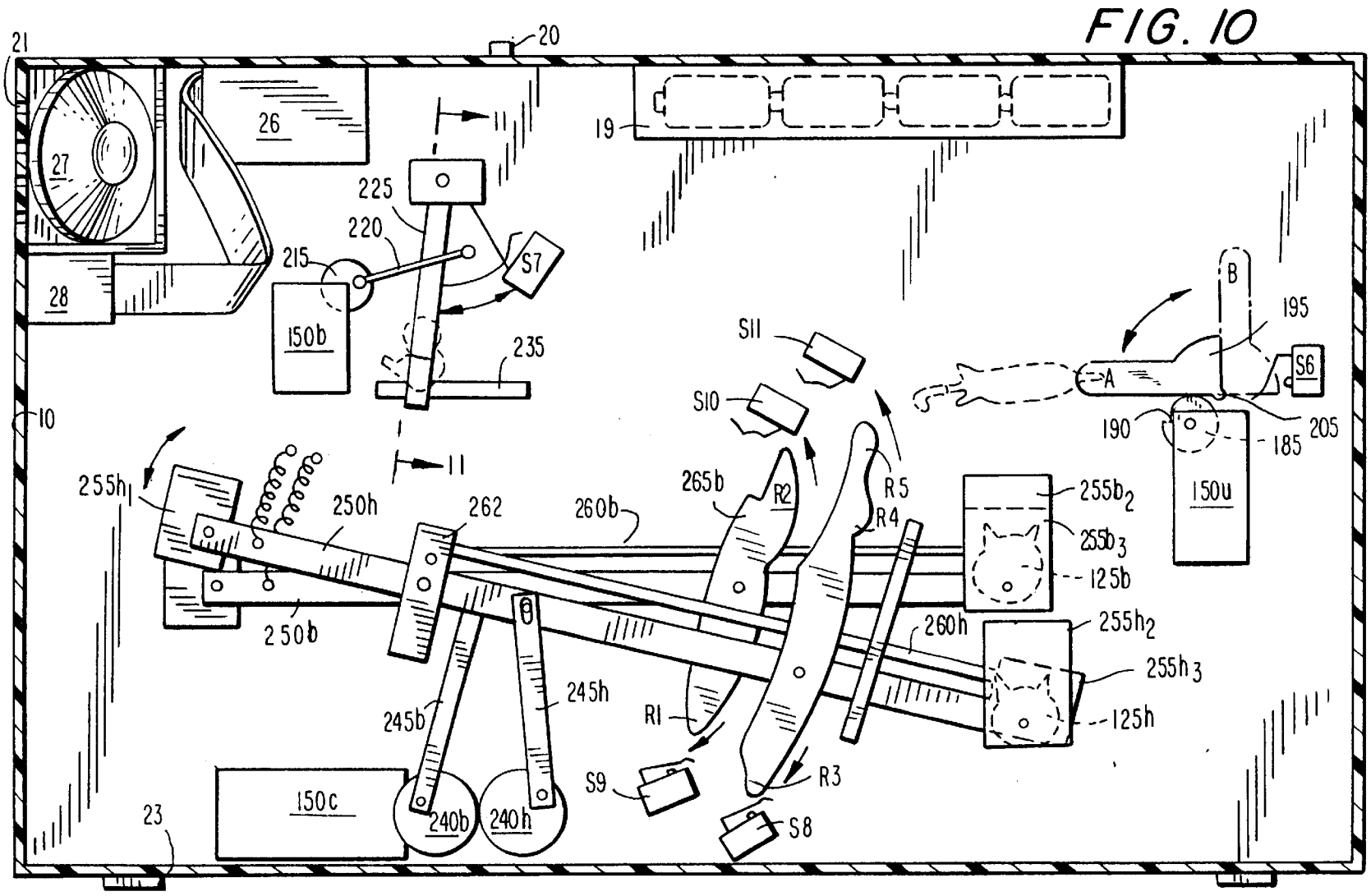
FIG. 10 is a cross-sectional view of the display of FIG. 9 along line X—X.

A second illustrative example of the modular dynamic dialogue animated display in accordance with the invention is shown in FIGS. 9 and 10. The storyline depicted in this second example is of a bird swinging in a cage while a cat on a pogo stick appears in the window to catch the bird. A universal main assembly similar to that in the first example is used in this second example. The main assembly includes a housing 10, a control unit 26 comprising a central processor UI and an audio processor U2 each with a corresponding memory or storage device for storing a sequence of storyline events and randomly-accessible audio blocks, respectively, a speaker 27, an audio unit 28, a power source 19, a power switch or button 20, and a start switch or button 24. The only difference in the main assemblies of the first and second examples being that the storyline and audio memories in the central processor U1 and audio processor U2 have been programmed for the particular storyline being recreated.

The second example has two scenery layers, e.g. an intermediate scenery layer 115 of a portion of a room in a house including a birdcage hanging from the ceiling near a window, and a background scenery layer 120 of the houses in the distance as seen through the window. Four moveable display elements are provided, i.e. a first cat face moveable display element $\mathbf{125}_h$, a second cat face moveable display element $\mathbf{125}_b$, a bird moveable display element 135, and an umbrella moveable display element 140.

Three sub-assemblies are used to move the four moveable display elements. Specifically, a single sub-assembly is used to move the two cat face moveable display elements $\mathbf{125}_h$, $\mathbf{125}_b$. As a result, of this streamlined construction the overall cost of manufacturing the display device for this storyline is reduced.

Figure 12A:
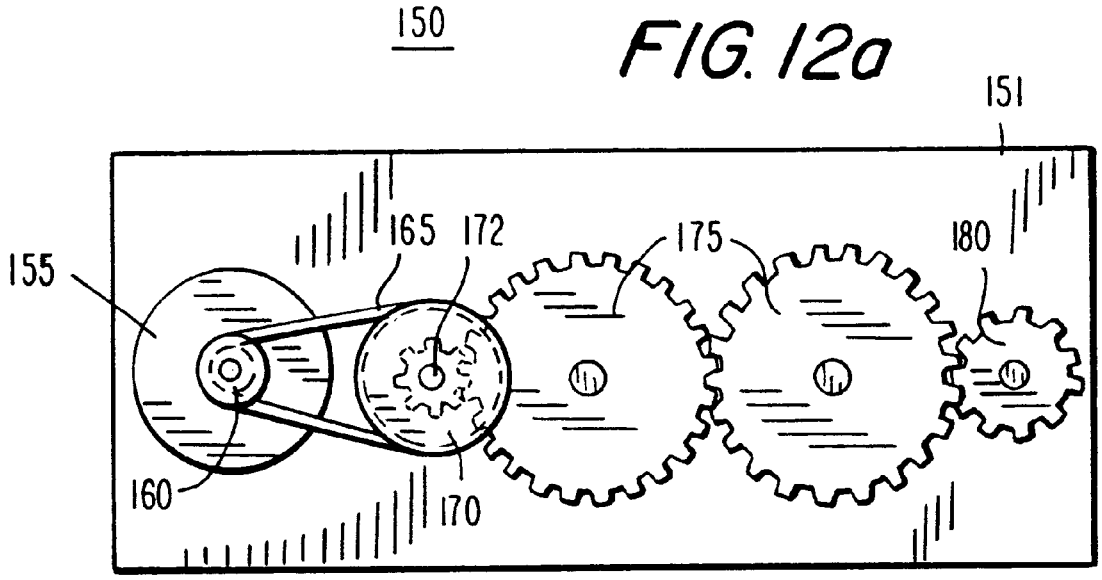
FIG. 12*a* is a detailed view of the gear box 150 of FIG. 10.

Each sub-assembly comprises a universal gear box 150, as shown in FIG. 12*a*. For purposes of notation only the universal gear boxes are referred to as $\mathbf{150}_C$, $\mathbf{150}_b$, $\mathbf{150}_u$, for the cat, bird and umbrella sub-assemblies, respectively. In each sub-assembly the universal gear box 150 includes a motor 155 for driving a first pulley 160. A belt 165 is disposed about the first pulley 160 and about a second pulley 170 having a larger diameter than the first pulley. Second pulley 170 includes a coaxial pinion 172 that engages a series of gears 175. As the gears 175 rotate they, in turn, engage an idler gear 180 that transmits output power from the universal gear box 150. In a preferred embodiment the components comprising the universal gear box are enclosed in a housing 151 that provides both protection and a support structure to which additional components may be mounted. In this regard, the output power produced by the universal gear box may be modified in order to achieve a particular action in accordance with the storyline being depicted by operatively connecting additional components such as gears to the idler gear 180. Thus, depending on the storyline being recreated, universal gear boxes may be used to provide action to a plurality, or all, of the moveable display elements and because of its universal design may be mass-produced by a single tooling thereby reducing the overall cost of manufacture of the display device.

The umbrella sub-assembly including the umbrella moveable display element 140 will now be described in detail. Operatively connected to the idler gear $\mathbf{180}_u$ of the universal gear box $\mathbf{150}_u$ is a snail-shaped cam 185 with a notch 190 defined in its circumference. The umbrella moveable display element 140 is mounted to a wedge-shaped pivoting member 195 that includes a rib 205 disposed so as to fit in the notch 190 of the snail-shaped cam 105 as it rotates. In operation, the bi-directional motor 155 in the universal gear box 150 is energized in a first direction and rotates the snail-shaped gear 190 in a counter-clockwise direction. As the snail-shaped gear 190 rotates it pushes against the rib 205 of the wedge-shaped pivoting member 195 and causes it to pivot from position B (where the umbrella moveable display element is concealed from view behind the intermediate scenery layer 115) to position A (where the umbrella comes into view as if to hit the cat). To return the pivoting member 195 to position B the motor 155 is reversed causing the snail-shaped cam 185 to rotate in a clockwise direction causing the wedge-shaped pivoting member 195 to engage switch S6. Motor 155 may be damaged when its direction is rapidly switched in this manner. Thus, in order to extend the useful life of the motor, the cam 185 is preferably configured in a snail-shape to provide a dwell time that allows the motor 155 to overrun.

Figure 11:
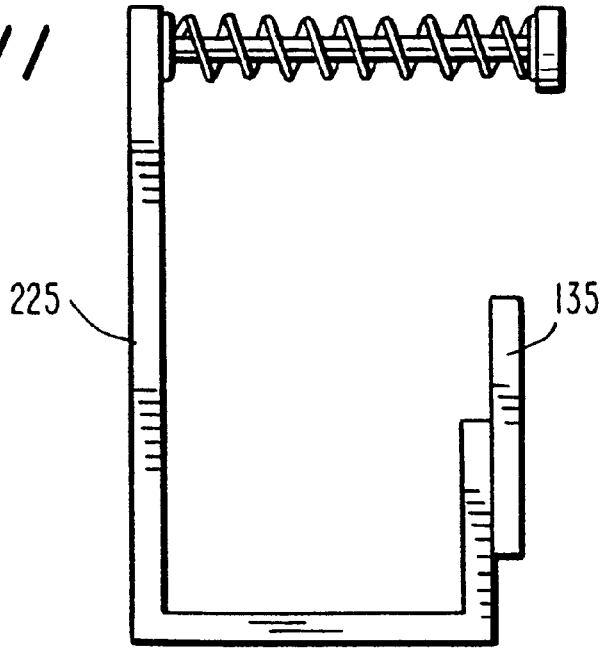
FIG. 11 is a side view of the swinging assembly of the bird sub-assembly of FIG. 10.

The bird sub-assembly, like the umbrella sub-assembly, also includes a universal gear box 150*b*. Operatively connected to the idler gear $\mathbf{180}_b$ of the universal gear box $\mathbf{150}_b$ is a bell crank 215. A rod 220 is attached at one end to the bell crank 215 and the other end is attached to a swing arm 225. The swing arm is preferably U-shaped, as illustrated in the side view of FIG. 11, with the bird moveable display element mounted to one side of the "U". As the swing arm swings back-and-forth it engages a switch S7. This sub-assembly includes delicate components which may be damaged during shipping and thus in a preferred embodiment additional support structures are provided. For example, the sub-assembly preferably includes a clutch to allow the swing arm to swing back-and-forth during shipping without moving the rod 220. Moreover, it is also desirable to include a support bar 235 interposed between the two sides of the U-shaped swing arm to prevent displacement of the swing arm in a direction either towards or away from the open face of the housing, which might otherwise damage the subassembly components.

The last sub-assembly to be described is the cat sub-assembly that provides motion for the first and second interchangeable cat face moveable display elements, i.e. the first of a cat on a pogo stick with a hungry face $\mathbf{125}_h$ (hereinafter "hungry cat face") and the second of a bruised cat $\mathbf{125}_b$ with the pogo stick wrapped around its body (hereinafter "bruised cat face"). The hungry and bruised cat face moveable display elements are driven using a single universal gear box 150. Similar components are used to drive the two cat face moveable display elements and for notation purposes they are denoted by the same reference number accompanied by an "h" or a "b" for the hungry and bruised cat face moveable display elements, respectively.

Operatively connected to the idler gear 180 of the universal gear box are two bell cranks in series $\mathbf{240}_b$, $\mathbf{240}_h$ for driving the cat face moveable display elements. Rods $\mathbf{245}_b$, $\mathbf{245}_h$ are attached at one end to bell cranks $\mathbf{240}_b$, $\mathbf{240}_h$, respectively, and at the opposite end to bars $\mathbf{250}_b$, $\mathbf{250}_h$, respectively. The ends of the rods $\mathbf{245}_b$, $\mathbf{245}_h$ are slotted at their connection to the bars $\mathbf{250}_b$, $\mathbf{250}_b$ in order to provide a dwell time, which is necessary since according to the storyline being depicted the first and second cat face moveable display elements are not in view at the same time. Counterweights are disposed at opposite ends of each of the bars $\mathbf{250}_b$, $\mathbf{250}_h$ which serve to balance the bars about a pivot point P in response to movements during shipping to prevent damage to the delicate sub-assembly components.

The weights are the same for the hungry and bruised cat face moveable display elements and thus the components for only the hungry moveable display element will be described in detail. A first weight $\mathbf{255}_{h1}$ is disposed on one side of the bar $\mathbf{250}_h$ and two weights $\mathbf{255}_{h2}$, $\mathbf{255}_{h3}$ are disposed on the opposite end of the bar. Arranged substantially parallel to the bar $\mathbf{250}_h$ is a four bar $\mathbf{260}_h$ which is attached at one end to a supporting member 262 and at the opposite end is mounted to a second weight $\mathbf{255}_{h2}$. The hungry cat face moveable display element $\mathbf{125}_h$ is mounted to the second weight $\mathbf{255}_{h2}$. Second weight $\mathbf{255}_{h2}$ is pivotally mounted to the bar $\mathbf{250}_h$ and attached to the four bar $\mathbf{250}_h$ so that it remains in a substantially erect position irrespective of the radial movement of the bar $\mathbf{250}_h$. A third weight $\mathbf{255}_{h3}$, smaller in size than the second weight $\mathbf{255}_{h2}$, is positioned between the second weight $\mathbf{255}_{h2}$ and the back of the housing 10 of the display. The third weight $\mathbf{255}_{h3}$ is mounted to the bar $\mathbf{250}_h$ at an angle of approximately 90 degrees so that the third weight moves radially with the bar. The slots allow for a dwell time when the weights $\mathbf{225}_{h2}$, $\mathbf{225}_{h3}$ are positioned at their lowest point.

Figure 12B:
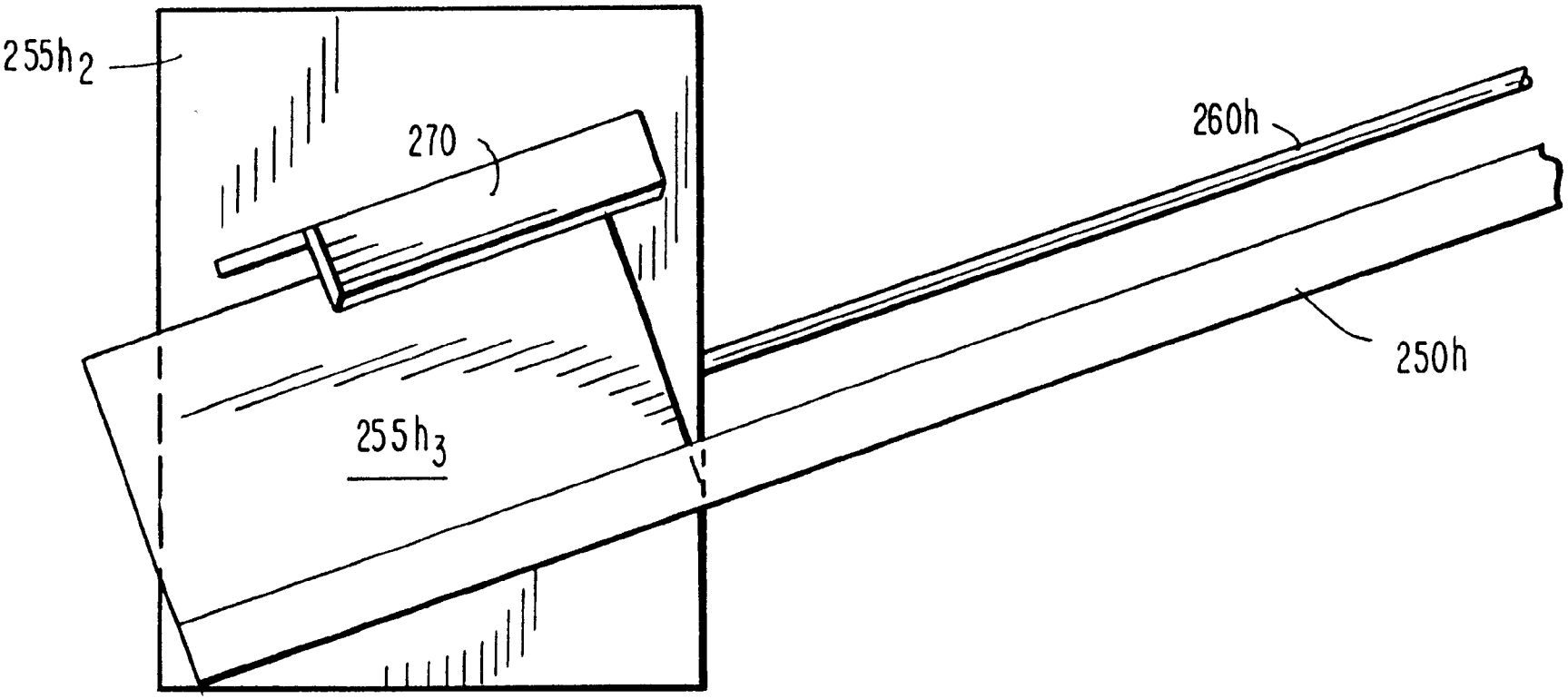
FIG. 12*b* is a partial back view of the weights $\mathbf{225}_{h2}$ and $\mathbf{255}_{h3}$ of the cat sub-assembly of FIG. 10.
Figure 13A:
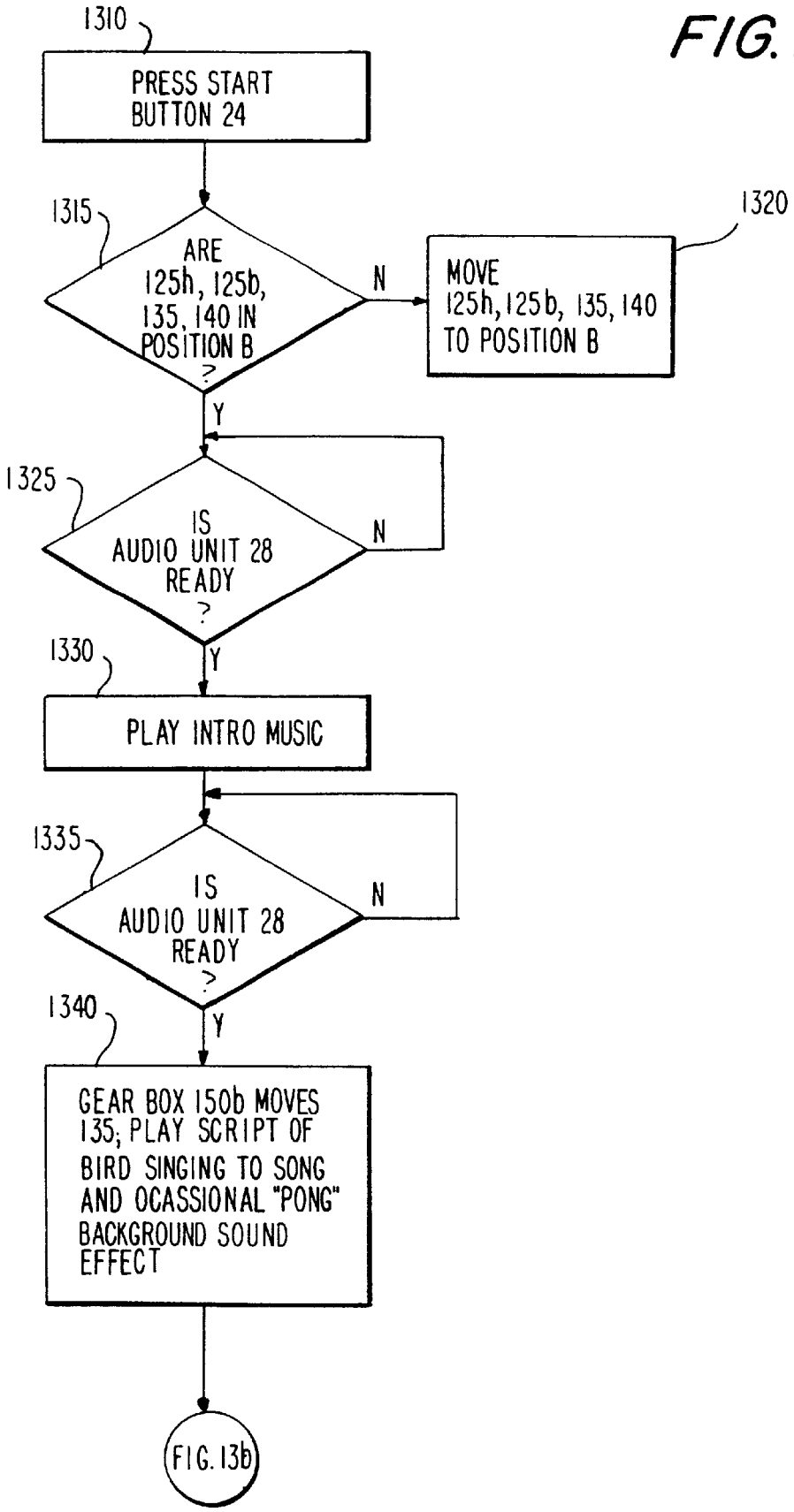
Figure 13B:
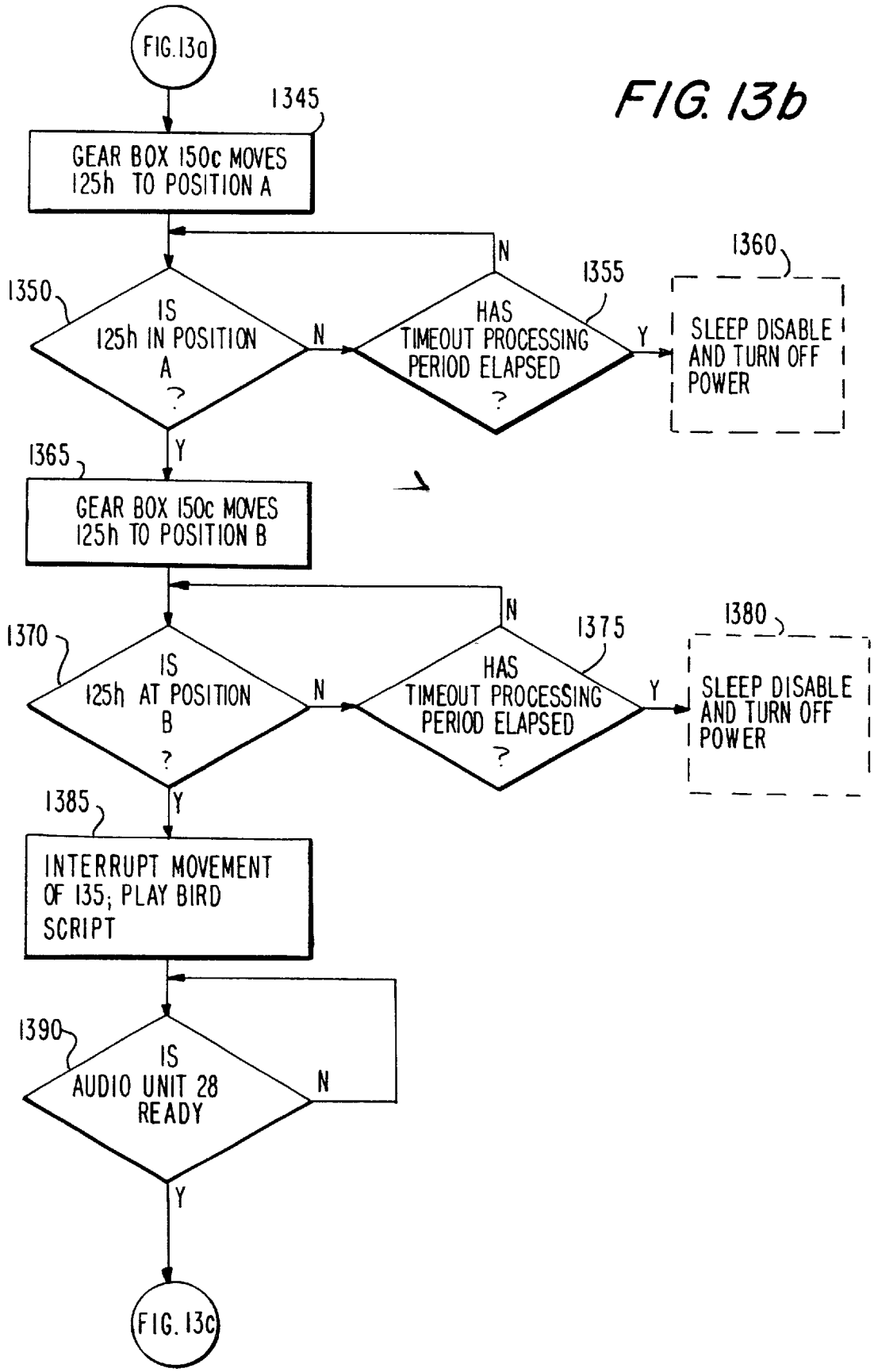
Figure 13C:
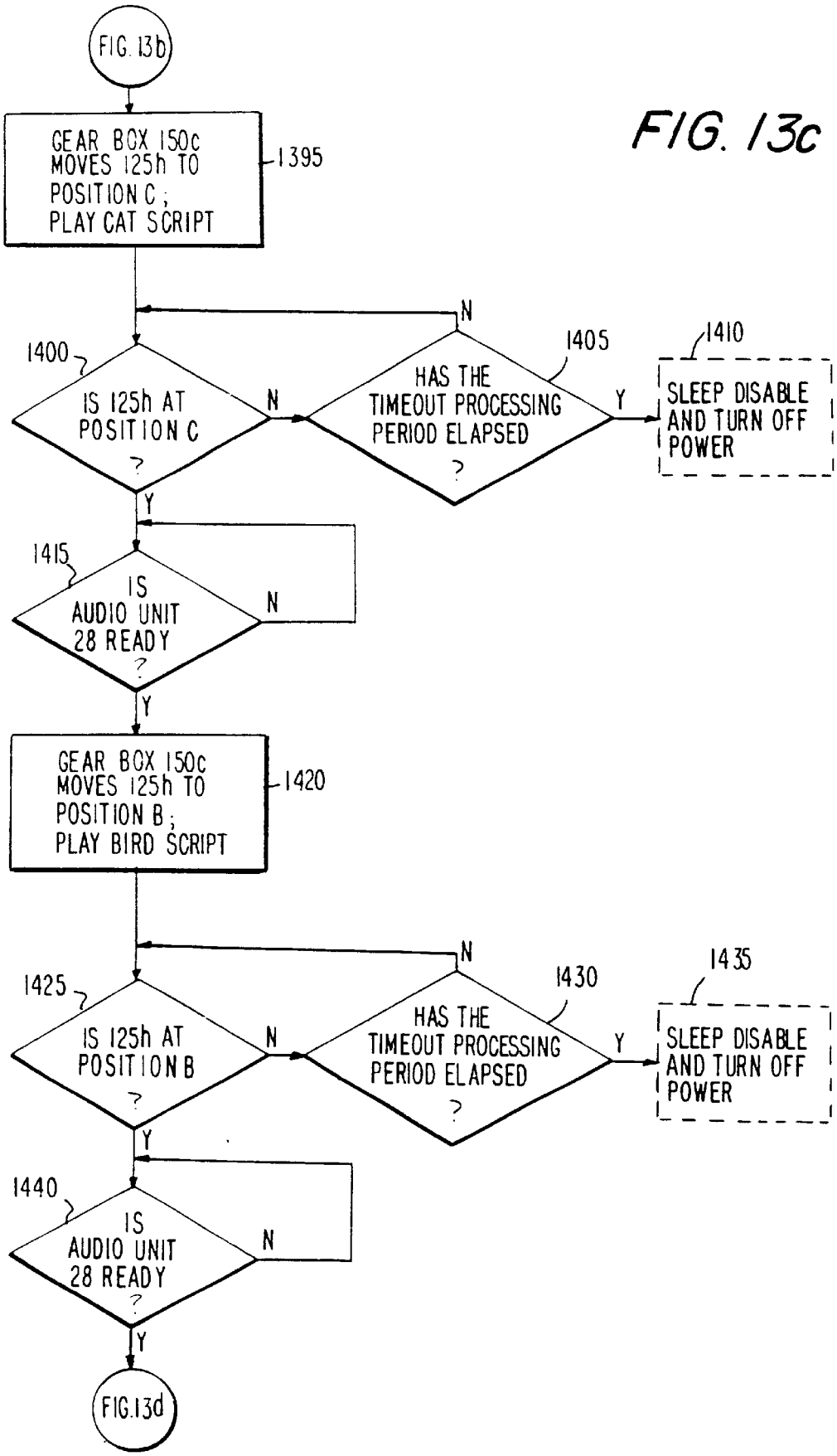
Figures 13C, 13D, 13E:
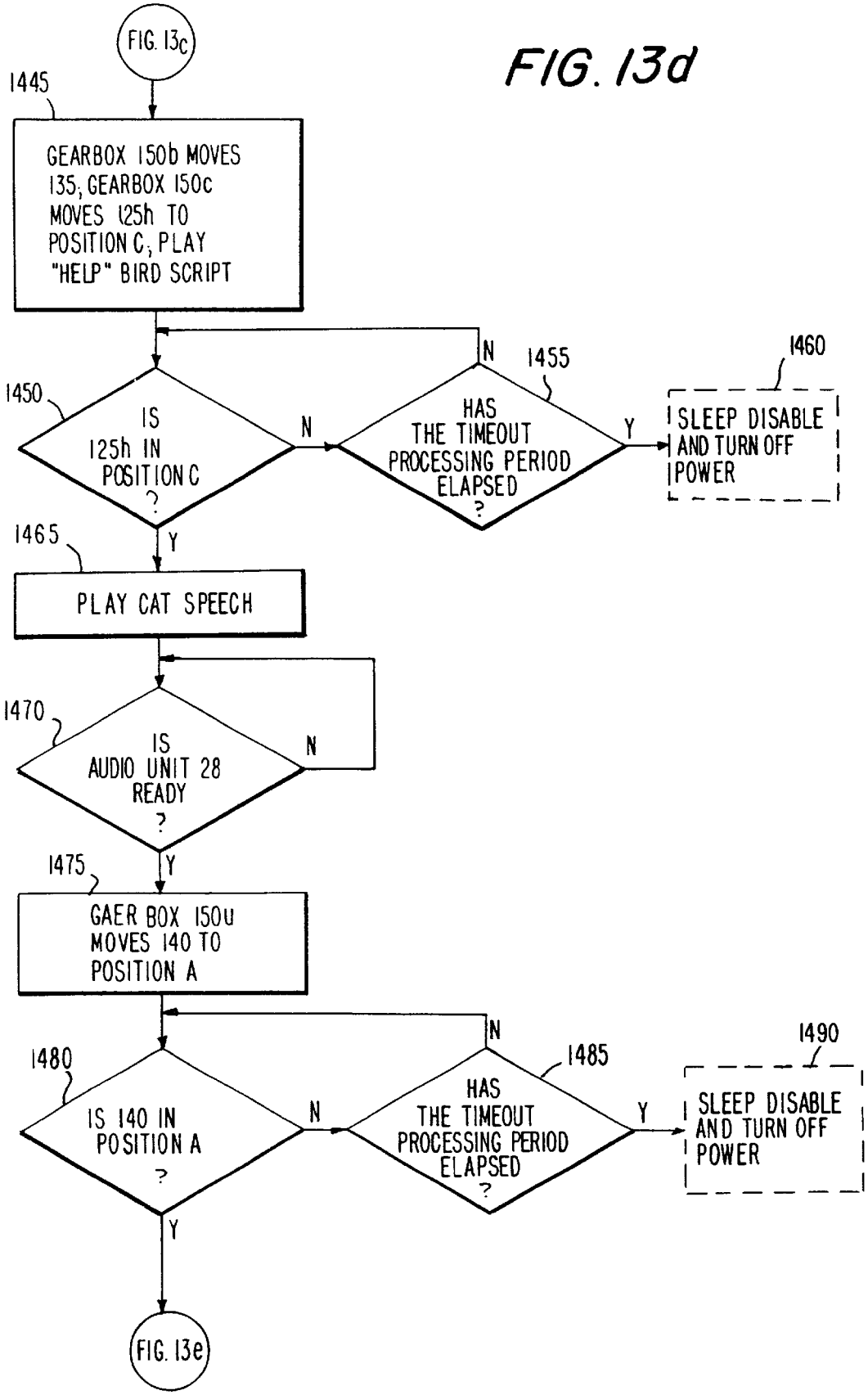
Figure 13F:
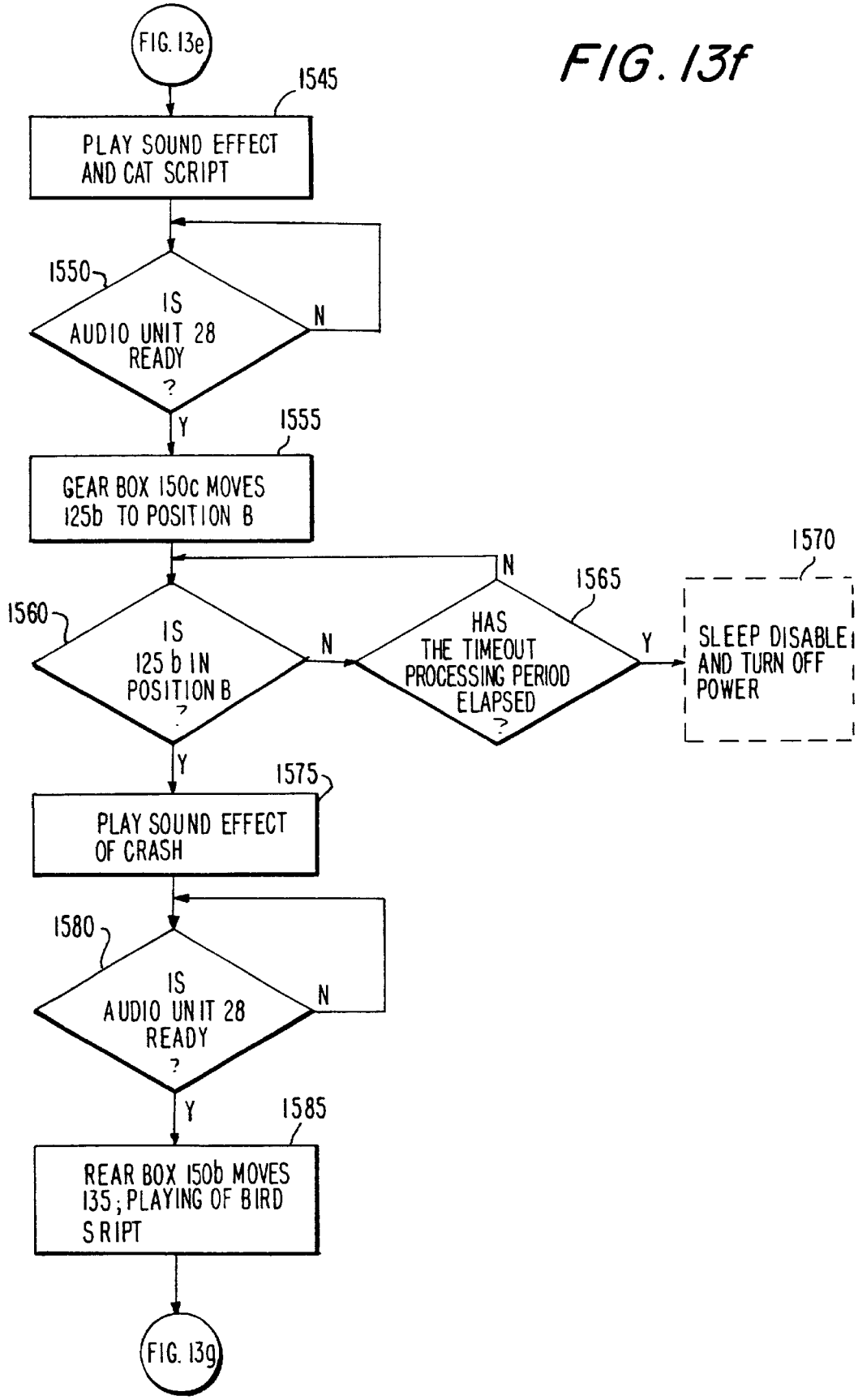

FIG. 12*b* shows a back view of a preferred embodiment of the weights $\mathbf{255}_{h2}$ and $\mathbf{255}_{h3}$. As shown, the second weight $\mathbf{255}_{h3}$ has a tilted ridge 270 disposed along its rear surface adjacent the front surface of the third weight $\mathbf{255}_{h3}$ that prevents displacement of the weights towards and away from one another. These delicate components of this sub-assembly may become displaced and damaged during shipping. Damage to the sub-assembly is prevented by positioning the bars $\mathbf{250}_b$, $\mathbf{250}_h$ between a double slotted support structure which restricts displacement of the bars towards and away from one another.

As the bars $\mathbf{250}_h$, $\mathbf{250}_b$ move radially members $\mathbf{265}_h$, $\mathbf{265}_b$ mounted thereto engage respective switches. The bruised cat face comes into view once and thus the engaging member $\mathbf{265}_b$ only requires two positions. Specifically, engaging member $\mathbf{265}_b$ is moved between two positions, i.e. position B (with the hungry cat face concealed behind the intermediate scenery layer 115) when rib R1 closes switch S9 and position A (with the hungry cat face in view in the window) when rib R2 engages switch S10. On the other hand, the hungry face cat display element comes into view at two different levels, e.g. a first level in which only the face of the hungry cat is seen in the window and a second higher level in which the pogo stick on which the cat is jumping is also in view in the window. These two different levels give the appearance that the cat is jumping higher on the pogo stick in order to reach the bird. To create this effect engaging member $\mathbf{265}_h$ is moved between position B (with the hungry cat face moveable display element concealed from view behind the intermediate scenery layer 115) when the rib R3 closes switch S8 and either position A (the first level) when the rib R5 engages switch S11 or position C (the second level) when the rib R4 closes switch S11. Springs $\mathbf{275}_b$, $\mathbf{275}_h$ are attached to bars $\mathbf{250}_b$, $\mathbf{250}_h$, respectively, to limit radial movement.

Figure 7E:
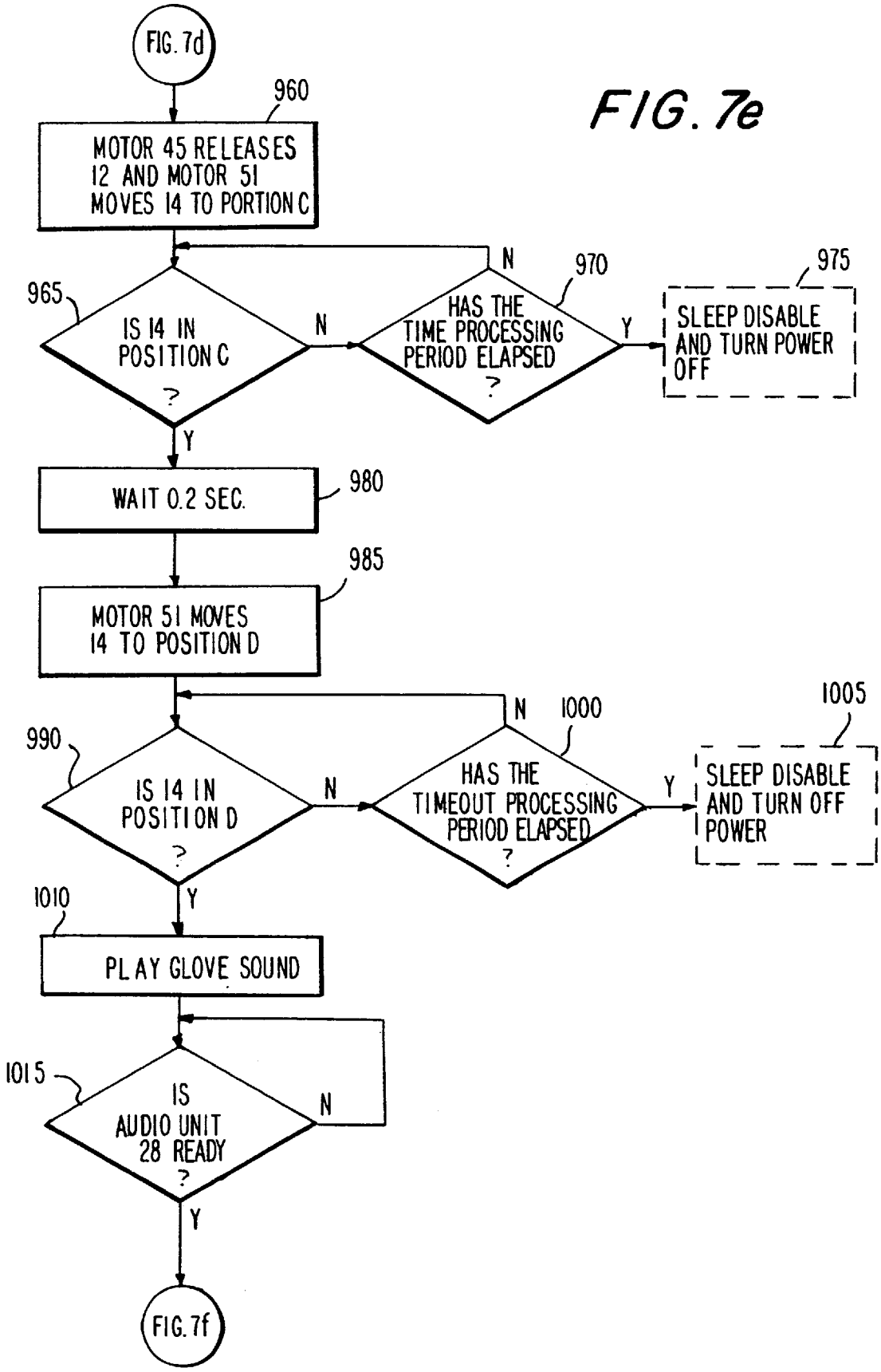
Figure 7F:
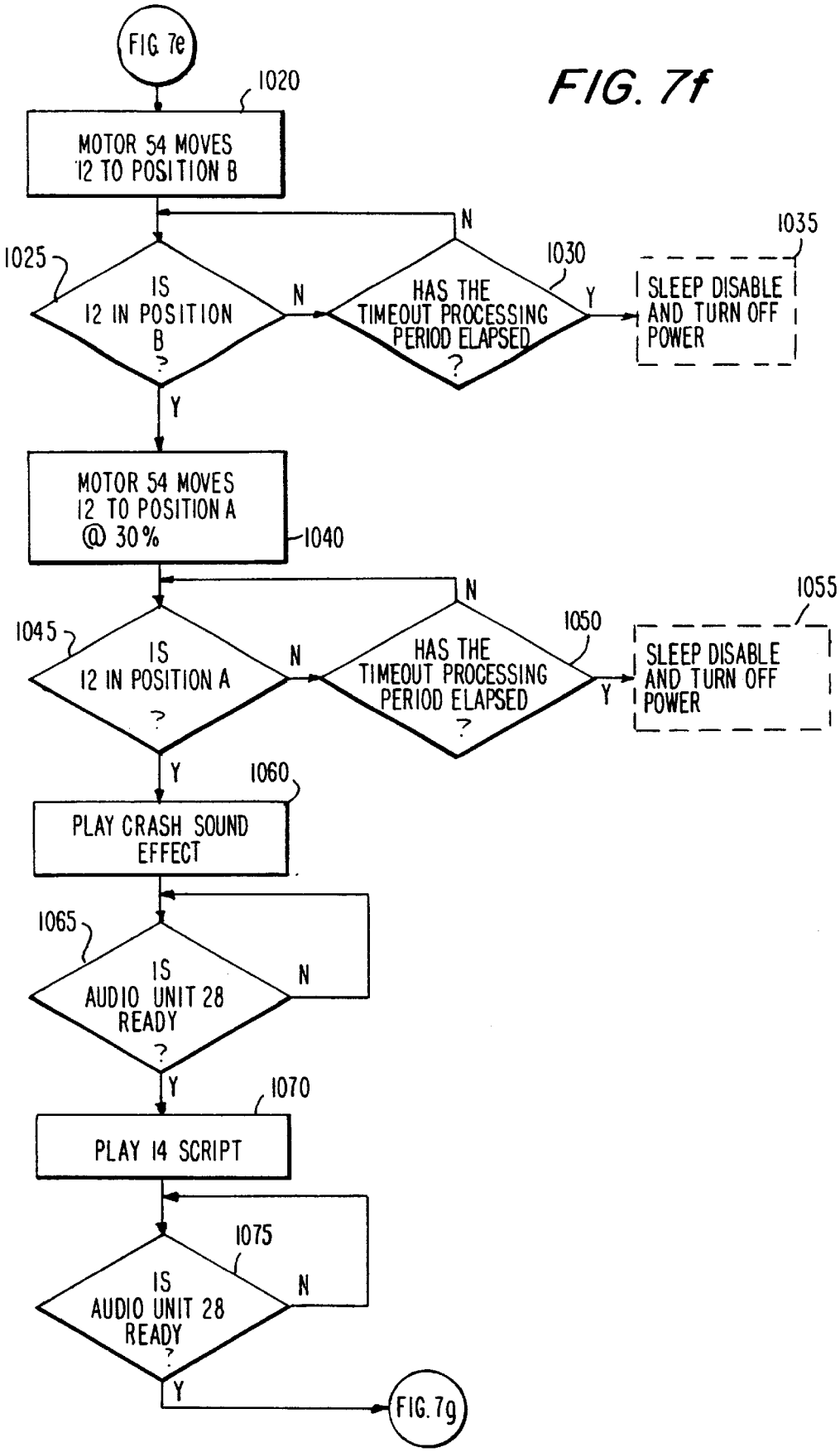
Figure 7G:
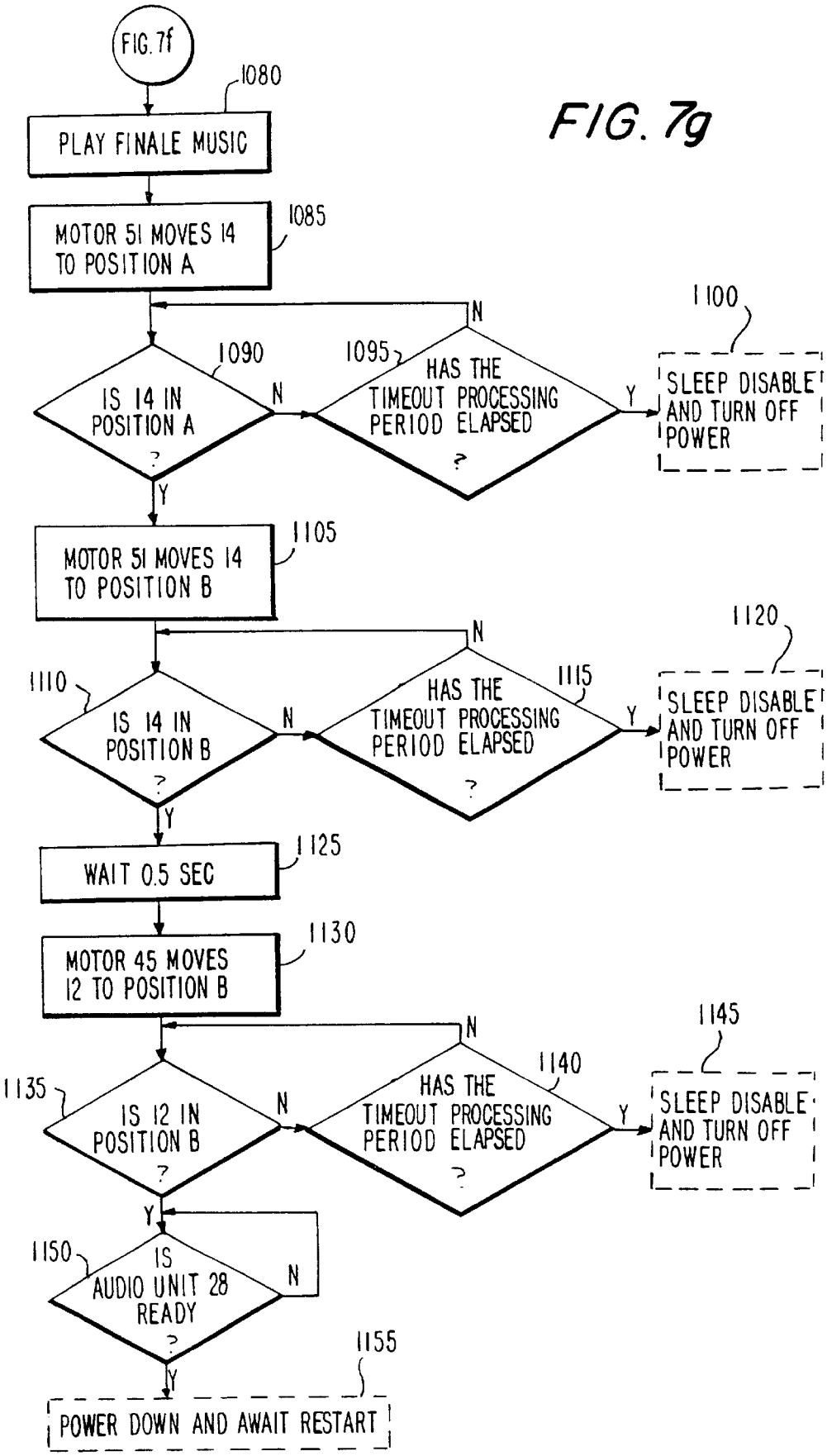

Operation of the second exemplary storyline is similar to that previously described in FIGS. 7*e* and 7*f* with respect to the first example in that when power is provided to the display a series of processing checks are performed to ensure that the moveable display elements are operable, that the switches are working properly and to clear the mechanism from small debris. After completion of this self-correcting procedure the display is sleep disabled to conserve energy and awaits actuation of the start button 24.

FIGS. 13*a–g* show the flow chart for the second storyline. Once the start button 24 is pressed another check is made in step 1310 to ensure that the moveable display elements are all positioned in reset position B and are moved to reset position B if any are not detected as being in that position. When the moveable display elements are in reset position B the audio unit 28 is continuously checked until it is ready to play a selected audio block at which point introductory music is played in step 1330. After completion of the playing of the introductory music in step 1335 gear box $\mathbf{150}_b$ then moves the bird moveable display element 135 in step 1340 so that it swings back-and-forth while playing an audio script of a bird singing to a song and in the background an occasional "PONG" background sound effect is played. In step 1345 gear box $\mathbf{150}_c$, moves the hungry cat face moveable display element $125_h$ from position B to position A where it is concealed from view behind the intermediate scenery layer 115. Then a timeout processing check is performed in steps 1350–1360 in which it is determined whether or not the hungry cat face moveable display element $125_h$ has reached position A within a predetermined timeout processing period. This timeout processing check is similar to that described above with respect to the first example. If the moveable display element has not reached the destination point before the timeout processing period has elapsed then the motor is presumed stuck, the processor is sleep disabled and the power is cut off in step 1360 to prevent the motor from becoming damaged. Similar processing is performed each time the moveable display element is moved and thus will not be further described.

Once the hungry cat face moveable display element $125_h$ is in position A it is then moved in steps 1365–1380 back to position B where it is once again concealed from view behind the intermediate scenery layer 115. In step 1385 gear box $150_b$ is interrupted so that the bird moveable display element 135 stops swinging and a bird script is played in which the bird states that it believes that it has just seen the cat. After completion of playing the bird script in steps 1395–1415 gear box $150_c$ moves the hungry cat face $125_h$ to the second level at position C while a cat script is played in which the cat addresses the bird. Then in steps 1420–1440 the gear box $150_c$ moves the hungry cat face moveable display element $125_h$ back to position B while a script is played of the bird acknowledging that it has in fact seen the cat. Having "seen" the cat the gear box $150_b$ in steps 1445–1460 moves the bird moveable display element 135 back-and-forth in the birdcage while playing an audio sound effect of the bird screaming for help. While the audio block of the bird screaming for help sound effect is played, gear box $125_c$ moves the hungry cat moveable display element $125_h$ to a second level at position C, higher than the first level at position A, so that the pogo stick on which the cat is jumping is now visible in the window. Upon reaching position C a cat script is played in steps 1465–1470 in which the cat states that it is going to catch the bird. In steps 1475–1490 gear box $150_u$ moves the umbrella moveable display element 140 to position B so that it appears to knock the cat in the head. When the umbrella moveable display element 140 reaches position B a "BONG" sound effect of the umbrella hitting the cat followed by a script of an elderly woman chastising the cat is played in step 1495. In steps 1500–1525 gear box $150_u$ then moves the umbrella moveable display element 140 back to position B and gear box $150_c$ moves the hungry cat moveable display element $125_h$ back to position B so that both are concealed from view behind the intermediate scenery layer 115. Gear box $150_c$ then moves the bruised cat face moveable display elements $125_b$ to position A in steps 1525–1540 and upon reaching position A in steps 1545–1550 plays a script of the cat astonished by what has just occurred. Then in steps 1555–1580 the gear box $150_c$ . moves the bruised cat face moveable display element $125_b$, back to position B and upon reaching position B plays an audio sound effect of a crash. The cat is no longer a threat and in steps 1585–1590 the gear box $150_b$ moves the bird moveable display element 135 back-and-forth in the birdcage while playing a bird script in which the bird comments about the cat. In steps 1595–1645 finale music is played while the hungry cat face moveable display element $125_h$ moves to position A for a curtain call and then returns back to position B. The storyline is now completed and the display is powered down and awaits restart in step 1650.

Although the modular dynamic dialogue animated display device in accordance with the invention has been shown as a single device, it is also within the intended scope of the invention to provide a plurality of individual display devices, arranged one after another, whereby a previous display device actuates performance in a next display device in order to depict different scenes from a single storyline. The plurality of display devices may be actuated by signals transmitted between adjacent display devices, for example, using electrical wires or a wireless communication means such as radio or infrared waves. In the preferred embodiment wireless communication between adjacent devices is accomplished using IR waves. FIGS. 14*a* and 14*b* show, by way of illustrative example only, three display devices A,B,C, however, any two or more display devices may be used as desired. As shown, the IR transmitters 275 are preferably positioned midway along the right-hand-side and bottom side of the perimeter of each display device. The corresponding IR sensors 280 of any two adjacent display devices are disposed at alternating diagonal corners. Specifically, in display device A the sensors 280 are positioned along the upper-left and lower-right corners, in display device B the sensors are positioned along the lower-left and upper-right corners, and the sensors in display device C are arranged the same as those in display device A. This configuration is desirable since it requires the minimum number of sensors yet accommodates arrangement of the plurality of display devices one after another in either a horizontal or vertical direction. Alternative arrangements of the transmitters and sensors, however, are also within the intended scope of the invention. A display device may continue its performance even after successive devices are actuated such that several scenes of the storyline are performed simultaneously.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve substantially the same results are within the scope of the invention. It is the intention, therefore, to be limited only as indicated by the scope of the claims appended hereto.

We claim:

1. An animated display device simulating a movable two-dimensional picture for presenting a viewable, self-contained story, said display device comprising:

a housing having a front viewing opening defining a plane and simulating in said plane a frame for a two-dimensional picture, said housing having a predetermined height and width and a relatively shallow depth;

at least one substantially planar scenery layer disposed in said housing substantially parallel to said plane of said viewing opening and viewable through said front opening, said scenery layer comprising part of said two-dimensional picture;

at least one subassembly disposed in said housing and comprising:

a substantially planar moveable display element comprising part of said two-dimensional picture and movable along a substantially planar path of travel, said path of travel being substantially parallel to said scenery layer; and an electromechanical driving mechanism for moving said moveable display element along said substantially planar path of travel, at least a portion of said at least one subassembly being concealed from viewing through said front viewing opening in said housing by said substantially planar scenery layer;

a storyline memory device for storing data corresponding to a plurality of storyline events specific to said self-contained story, the plurality of storyline events comprising at least a movement of said moveable display element; and a processor electrically connected to said electromechanical driving mechanism and to said storyline memory device for retrieving said data corresponding to said storyline events and for generating corresponding control signals for transmission to said electromechanical driving mechanism for moving said at least one moveable display element in its substantially planar path of travel such that sequential execution of said storyline events by said processor presents said self-contained story through said front viewing opening in said housing.

2. The device in accordance with claim 1, wherein said device comprises at least two sub-assemblies.

3. The device in accordance with claim 1, wherein said storyline memory device further comprises a programmable audio memory device for storing audio data representing sounds specific to the self-contained story being depicted, wherein said plurality of storyline events further comprises at least a playing of a selected audio data from said audio memory device, and wherein said processor is electrically connected to said audio memory device for generating control signals for selecting and playing audio data from said audio memory device in synchronization with movement of said moveable display element; and further comprising a speaker electrically connected to said processor for producing an audio sound corresponding to said selected audio data.

4. The device in accordance with claim 3, wherein said processor retrieves and initiates performance of a next storyline event from said storyline memory device upon completion of playing of said selected audio data from said audio memory.

5. The device in accordance with claim 3, wherein said sub-assembly further comprises a switch electrically connected to said processor and disposed along the substantially planar path of travel of said moveable display element, wherein in an engaged state said switch generates a closure signal.

6. The device in accordance with claim 5, wherein said processor retrieves and initiates performance of a next storyline event from said storyline memory device upon receiving the closure signal transmitted by said switch.

7. The device in accordance with claim 5, wherein said processor retrieves and initiates performance of a next storyline event from said storyline memory device upon completion of playing of said selected audio data from said audio memory and receiving the closure signal transmitted by said electronic switch.

8. The device in accordance with claim 1, wherein said processor retrieves and initiates performance of a next storyline event from said storyline memory device when a predetermined period of time has elapsed sine initiation of movement of said moveable display element to a previous storyline event.

9. The device in accordance with claim 5, wherein the audio data comprises an audio data loop and said plurality of storyline events comprises at least continuously playing the audio data loop until said processor receives the closure signal transmitted by said switch.

10. The device in accordance with claim 5, wherein the audio data comprises an audio data loop and said plurality of storyline events comprises at least continuously playing the audio data loop until said processor receives the closure signal transmitted by said switch and completion of playing of a current cycle of the audio data loop.

11. The device in accordance with claim 1, wherein said processor comprises a timer for monitoring a time period since initiation of movement of said moveable display element for a particular storyline event, and wherein said processor generates an interrupt signal to stop movement of said moveable display element when the time period exceeds a predetermined timeout processing period.

12. The device in accordance with claim 1, wherein said processor comprises duty cycling circuitry for varying a duty cycle of said electromechanical driving mechanism that moves said moveable display element in the substantially planar path of travel according to a given storyline event.

13. The device in accordance with claim 1, wherein said electromechanical driving mechanism comprises:

a support rail disposed along the substantially planar path of travel of said moveable display element;

a carriage supported by and displaceable along said support rail, and wherein said moveable display element is pivotally mounted to said carriage; and a first motor for driving said carriage along said support rail in a first direction at a first speed.

14. The device in accordance with claim 13, wherein said electromechanical driving mechanism further comprises a second motor for driving said carriage in a second direction along said support rail opposite the first direction and at a second speed different from the first speed.

15. The device in accordance with claim 14, wherein said first motor is a uni-directional motor and said second motor is a bi-directional motor.

16. The device in accordance with claim 13, wherein said electromechanical driving mechanism further comprises an undulating cam and a cam follower, and wherein said cam follower contacts said cam as said carriage moves along said support rail whereby said moveable display element pivots back-and-forth as it moves along its support rail.

17. The device in accordance with claim 5, wherein said electromechanical driving mechanism comprises:

a support rail disposed along the substantially planar path of travel of said moveable display element;

a carriage supported by and displaceable along said support rail, and wherein said moveable display element is mounted to said carriage;

a spring connected at one end to said carriage;

a rack connected to the other end of said spring, said rack being supported by and displaceable along said support rail along the path of travel;

a pinon disposed so as to operatively engage and move said carriage and said rack along said support rail;

a motor for rotating said pinon and, in turn, driving said carriage and said rack together along said support rail; and an actuating member projecting from said rack a sufficient distance to engage said switch as said carriage moves along said support rail.

18. The device in accordance with claim 1, further comprising a lamp, and wherein said plurality of storyline events comprises at least a lighting of said lamp.

19. The device in accordance with claim 1, wherein said electromechanical driving mechanism further comprises a gear box including:

a bidirectional motor;

a first pulley rotated by said motor, said first pulley having a first diameter;

a belt disposed about said first pulley;

a second pulley having a second diameter larger than the first diameter of said first pulley, said belt being disposed about said second pulley;

a pinon disposed coaxially with respect to said second pulley;

a first plurality of gears operatively interconnected in series and including a first gear and a last gear, said plurality of gears being arranged with the first gear engaging said pinon; and an idler gear engaging the last gear of said first plurality of gears, said idler gear producing a transmitted output power from said gear box.

20. The device in accordance with claim 19, wherein said electromechanical driving mechanism further comprises:

a cam disposed to engage and rotate with said idler gear; and a pivoting member engaging said cam and rotatable thereby between two positions.

21. The device in accordance with claim 19, wherein said electromechanical driving mechanism further comprises:

a bell crank disposed to engage and rotate with said idler gear of said gear box;

a rod mounted at one end to said bell crank; and a swinging assembly mounted to the other end of said rod, and wherein said moveable display element is mounted to said swinging assembly.

22. The device in accordance with claim 19, wherein said electromechanical driving mechanism further comprises:

a second plurality of gears operatively interconnected in series and including a third gear that engages said idler gear and a fourth gear that engages said third gear;

a pair of rods, each rod being mounted at one end to a respective one of said second plurality of gears;

a pair of bars, each bar being mounted to the other end of a respective rod and rotatable about a pivot point;

a pair of first weights, each first weight being disposed on one end of a respective bar;

a pair of second weights and a pair of third weights, each second weight being pivotally connected to the other end of a respective bar and each third weight being fixedly connected to the other end of a respective bar; and a pair of four bars extending substantially parallel to a respective bar, each four bar being fixedly connected to a respective second weight to maintain said moveable display element in a substantially erect position irrespective of radial movement of said bars.

23. The device in accordance with claim 22, wherein the opposite end of each rod is slotted at its connection to its respective bar.

24. The device in accordance with claim 23, each second weight having a rear surface adjacent each respective third weight, and further comprising a tilted ridge mounted to the rear surface of a respective second weight and disposed such that as each bar pivots radially, each third weight is guided by said tilted ridge so as to restrict displacement of each third weight relative to each second weight.

25. An animated display assembly simulating a movable two-dimensional picture for presenting a viewable, self-contained story comprising a plurality of different scenes, comprising:

a plurality of dynamic dialogue animated display units depicting different scenes of said self-contained story arranged in a predetermined direction, and wherein said units comprise adjacent units including a previous unit and a next unit, wherein the previous unit generates an actuation signal for initiating performance of the sequence of storyline events in the next unit, and wherein each unit comprises:

a housing having a front viewing opening defining a plane and simulating in said plane a frame for a two-dimensional picture, said housing having a predetermined height and width and a relatively shallow depth;

at least one substantially planar scenery layer disposed in said housing substantially parallel to said plane of said viewing opening and viewable through said front opening, said scenery layer comprising part of said two-dimensional picture;

at least one subassembly disposed in said housing and comprising:

a substantially planar moveable display element comprising part of said two-dimensional picture and movable along a substantially planar path of travel, said path of travel being substantially parallel to said scenery layer; and an electromechanical driving mechanism for moving said moveable display element along said substantially planar path of travel, at least a portion of said at least one subassembly being concealed from viewing through said front viewing opening in said housing by said substantially planar scenery layer;

a storyline memory device for storing data corresponding to a plurality of storyline events specific to said self-contained story, the plurality of storyline events comprising at least a movement of said moveable display element; and a processor electrically connected to said electromechanical driving mechanism and to said storyline memory device for retrieving said data corresponding to said storyline events and for generating corresponding control signals for transmission to said electromechanical driving mechanism for moving said at least one moveable display element in its substantially planar path of travel such that sequential execution of said storyline events by said processor presents said self-contained story through said front viewing opening in said housing;

means for generating an actuation signal which initiates performance of the storyline events in the next unit, said generating means being electrically connected to and controlled in response to the control signal generated by said processor; and means for receiving the actuation signal from said generating means of the previous unit, said processor being electrically connected to said receiving means and initiating performance of the sequence of storyline events in the next unit upon receipt of the actuation signal.

26. The assembly in accordance with claim 25, wherein said generating means comprises at least one infrared transmitter and said receiving means comprises at least one infrared sensor.

27. The assembly in accordance with claim 26, wherein said generating means comprises two infrared transmitters disposed along adjacent sides of said unit and two infrared sensors disposed at diagonal corners of said unit, wherein the infrared sensors of any two adjacent units are disposed at alternating diagonal corners with respect to one another.

28. The assembly in accordance with claim 27, wherein the infrared transmitters are disposed along a bottom and right sides of each unit.

29. The assembly in accordance with claim 25, wherein said plurality of units are arranged one after another in one of a horizontal and a vertical direction.

30. The assembly in accordance with claim 25, wherein each unit comprises at least two sub-assemblies.

31. A method for simulating a movable two-dimensional picture for presenting a viewable, self-contained story using an animated display device including a housing having a front viewing opening defining a plane and simulating in said plane a frame for a two-dimensional picture, at least one substantially planar scenery layer comprising part of said two-dimensional picture and disposed in said housing so as to be viewable through said front opening, and at least one sub-assembly disposed in said housing substantially parallel to said plane of said viewing opening and including a substantially planar moveable display element and an electromechanical driving mechanism for moving said moveable display element, said method comprising the steps of:

(a) retrieving from a programmable storyline memory device data corresponding to a plurality of storyline events specific to said self-contained story using a processor, wherein the plurality of storyline events comprise at least a movement of the substantially planar moveable display element along a substantially planar path of travel substantially parallel to said scenery layer;

(b) generating using the processor control signals corresponding to the retrieved storyline events;

(c) initiating in response to the generated control signal movement of said moveable display element along the substantially planar path of travel using an electromechanical driving mechanism, wherein at least a portion of said at least one subassembly is concealed from viewing through said front viewing opening in said housing by said substantially planar scenery layer; and (d) retrieving a next storyline event in the storyline memory and repeating step (b) to recreate said self-contained story through said front viewing opening in said housing.

32. The method in accordance with claim 31, wherein step (c) further comprises the step of playing of selected audio data representing sounds specific to the self-contained story being depicted from an audio memory device using a speaker in response to the control signal generated by said processor.

33. The method in accordance with claim 31, before step (a) further comprising the steps of:

(e) applying power to said processor; and (f) performing self-correcting processing.

34. The method in accordance with claim 33, wherein step (f) comprises the step of checking at least one of the operability of the moveable display element and processor, wherein if at least one of the moveable display element and processor is not operating, further comprising the step of disabling said display.

35. The method in accordance with claim 33, wherein step (f) comprises the step of checking to determine if a power supply is sufficient, wherein if the power supply is insufficient, further comprising the step of initiating a power supply replacement request and disabling said display.

36. The method in accordance with claim 33, wherein step (f) comprises the steps of checking if the moveable display element is in a reset position, wherein if the moveable display element is not in the reset position, further comprising the step of moving the moveable display element to the reset position.

37. The method in accordance with claim 36, wherein the step of checking if the moveable display element is in the reset position further comprises the step of checking continuously to determine whether a time period since initiation of movement of the moveable display element to the reset position exceeds a predetermined timeout processing period, wherein if the time period exceeds the predetermined timeout processing period further comprising the step of disabling said display.

38. The method in accordance with claim 31, before step (a) further comprising the steps of:

(g) generating a start signal; and (h) performing reset processing.

39. The method in accordance with claim 38, wherein step (h) further comprises the step of checking if the moveable display element is in a reset position, wherein if the moveable display element is not in the reset position, further comprising the step of driving the moveable display element to the reset position.

40. The method in accordance with claim 38, wherein step (h) further comprises the step of continuously checking until the processor is finished playing a previously selected audio data.

41. The method in accordance with claim 32, wherein step (c) further comprises the steps of:

(i) continuously checking to determine whether a time period since initiation of movement of the moveable display element exceeds a predetermined intermediate processing period, wherein if the time period exceeds the predetermined timeout processing period further comprising the steps of;

(j) interrupting movement of the moveable display element;

(k) playing of intermediate audio data from the audio memory; and (l) resuming movement of the moveable display element upon completion of playing of the intermediate audio data.

42. The method in accordance with claim 31, wherein step (c) further comprises the step of continuously checking to determine whether a time period since initiation of movement of the moveable display element exceeds a predetermined timeout processing period, wherein if the time period exceeds the predetermined timeout processing period further comprising the step of disabling said display.

43. The method in accordance with claim 32, wherein step (d) comprises the step of retrieving the next storyline event in the storyline memory upon completion of playing of the selected audio data from said audio memory.

44. The method in accordance with claim 31, wherein step (d) comprises the steps of retrieving the next storyline event in the storyline memory upon said moveable display element engaging a switch disposed along the path of travel.

45. The method in accordance with claim 32, wherein step (d) comprises the step of retrieving the next storyline event in the storyline memory upon completion of playing of the selected audio data from said audio memory and upon said moveable display element engaging a switch disposed along the path of travel.

46. The method in accordance with claim 31, wherein step (d) comprises the step of retrieving the next storyline event in the storyline memory when a predetermined period of time has elapsed since initiation of performance of movement of said moveable display element to a previous storyline event.

47. The method in accordance with claim 32, wherein step (c) further comprises the step of continuously playing an audio data loop until said moveable display element engages a switch disposed along the path of travel and completion of playing of a current cycle of the audio data loop.

* * * * *